US009085066B2

(12) United States Patent
Mattson et al.

(10) Patent No.: US 9,085,066 B2
(45) Date of Patent: Jul. 21, 2015

(54) TENSION LOCKING TOOL

(75) Inventors: Christopher Andrew Mattson, Provo, UT (US); Brian G. Winder, Ridgecrest, CA (US); Allen Boyd Mackay, Flagstaff, AZ (US); Joseph O. Jacobsen, Pleasant Grove, UT (US); Peter A. Halverson, Alpine, UT (US); Spencer Frezer, Lynnwood, WA (US)

(73) Assignee: Brigham Young University, Provo, UT (US)

( * ) Notice: Subject to any disclaimer, the term of this patent is extended or adjusted under 35 U.S.C. 154(b) by 0 days.

(21) Appl. No.: 12/881,030

(22) Filed: Sep. 13, 2010

(65) Prior Publication Data

US 2011/0083281 A1 Apr. 14, 2011

Related U.S. Application Data

(63) Continuation of application No. 12/104,323, filed on Apr. 16, 2008, now Pat. No. 7,793,570.

(60) Provisional application No. 60/923,928, filed on Apr. 17, 2007.

(51) Int. Cl.

| | |
|---|---|
| ***B25B 7/12*** | (2006.01) |
| ***B25B 7/08*** | (2006.01) |
| ***B25B 7/10*** | (2006.01) |
| ***B25B 7/14*** | (2006.01) |
| *B25B 13/28* | (2006.01) |
| *B25B 13/18* | (2006.01) |

(52) U.S. Cl.

CPC . *B25B 7/123* (2013.01); *B25B 7/08* (2013.01); *B25B 7/10* (2013.01); *B25B 7/12* (2013.01); *B25B 7/14* (2013.01); *B25B 13/18* (2013.01); *B25B 13/28* (2013.01)

(58) Field of Classification Search

CPC ..... B25B 7/12; B25B 7/10; B25B 7/123; B25B 13/18; B25B 13/28

USPC ..... 81/367–384, 318–327

See application file for complete search history.

(56) References Cited

U.S. PATENT DOCUMENTS

| | | | | |
|---|---|---|---|---|
| 507,973 | A | 10/1893 | Cox | |
| 1,551,328 | A | 8/1925 | Perry | |
| 2,701,487 | A | 2/1955 | Ortman | |
| 2,712,252 | A | 7/1955 | Landis | |
| 2,713,803 | A * | 7/1955 | Schwaiger | 81/383 |
| 2,814,222 | A | 11/1957 | Sanders | |
| 2,991,545 | A * | 7/1961 | Wuischpard | 29/807 |
| 2,995,794 | A | 8/1961 | Hacking | |
| 3,229,554 | A | 1/1966 | Haddad | |
| 4,719,700 | A | 1/1988 | Taylor, Jr. | |
| 4,744,272 | A | 5/1988 | Leatherman | |
| 5,029,355 | A * | 7/1991 | Thai | 7/118 |
| 5,062,173 | A | 11/1991 | Collins et al. | |
| 5,142,721 | A | 9/1992 | Sessions et al. | |
| 5,212,844 | A | 5/1993 | Sessions et al. | |
| D338,386 | S | 8/1993 | Frazer | |

(Continued)

*Primary Examiner* — Monica Carter
*Assistant Examiner* — Danny Hong

(57) ABSTRACT

A hand tool having first and second plier units attached to one another where a jaw region is operatively configured to have a work piece to be placed therein and a handle region is configured to be used by the user of the tool to grasp the work piece. A tension member is provided to be positioned past a dead point axis so as to apply a clamping force upon the jaw member and the hand tool maintains a grip upon the work piece without continuous interaction with the user of the tool.

15 Claims, 33 Drawing Sheets

(56) References Cited

U.S. PATENT DOCUMENTS

| | | | | | |
|---|---|---|---|---|---|
| 5,267,366 | A | * | 12/1993 | Frazer | 7/128 |
| 5,331,741 | A | | 7/1994 | Taylor, Jr. | |
| 5,367,774 | A | | 11/1994 | Labarre et al. | |
| 5,385,072 | A | | 1/1995 | Neff | |
| D356,019 | S | | 3/1995 | Sakai | |
| 5,459,929 | A | | 10/1995 | Linden et al. | |
| D366,408 | S | | 1/1996 | Sessions et al. | |
| 5,495,674 | A | | 3/1996 | Taylor, Jr. | |
| D368,634 | S | | 4/1996 | Frazer | |
| 5,511,310 | A | | 4/1996 | Sessions et al. | |
| 5,572,793 | A | | 11/1996 | Collins et al. | |
| 5,809,599 | A | * | 9/1998 | Frazer | 7/128 |
| 5,819,414 | A | | 10/1998 | Marifone | |
| 5,822,866 | A | | 10/1998 | Pardue | |
| 5,829,329 | A | | 11/1998 | Frazer | |
| D403,569 | S | | 1/1999 | Frazer | |
| D410,189 | S | | 5/1999 | Wehrs et al. | |
| 5,916,277 | A | | 6/1999 | Dallas | |
| 5,946,752 | A | | 9/1999 | Parrish | |
| 5,957,013 | A | | 9/1999 | Frazer | |
| 5,960,498 | A | | 10/1999 | Nabors et al. | |
| 6,003,180 | A | | 12/1999 | Frazer | |
| 6,006,385 | A | | 12/1999 | Kershaw et al. | |
| D421,668 | S | | 3/2000 | Frazer | |
| 6,070,504 | A | | 6/2000 | Frazer | |
| 6,088,860 | A | | 7/2000 | Poehlmann et al. | |
| 6,219,870 | B1 | | 4/2001 | Swinden et al. | |
| D446,571 | S | | 8/2001 | Frazer | |
| 6,282,996 | B1 | * | 9/2001 | Berg et al. | 81/427.5 |
| 6,282,997 | B1 | | 9/2001 | Frazer | |
| 6,474,202 | B2 | | 11/2002 | Frazer | |
| 6,658,971 | B2 | | 12/2003 | Delbrugge, Jr. et al. | |
| 6,721,983 | B2 | | 4/2004 | Dallas et al. | |
| 6,721,984 | B1 | | 4/2004 | Harrison | |
| 6,941,661 | B2 | | 9/2005 | Frazer | |
| 7,063,435 | B2 | | 6/2006 | Dallas et al. | |
| 7,124,510 | B2 | | 10/2006 | Frazer | |
| 2001/0037705 | A1 | | 11/2001 | Frazer | |
| 2003/0140425 | A1 | | 7/2003 | Ping | |
| 2005/0194238 | A1 | | 9/2005 | Frazer | |
| 2011/0083281 | A1 | * | 4/2011 | Mattson et al. | 7/125 |

* cited by examiner

TENSION LOCKING TOOL

RELATED APPLICATIONS

This application is a Continuation of U.S. Ser. No. 12/104,323, filed Apr. 16, 2008 (U.S. Pat. No. 7,793,570), which claims priority benefit of U.S. Ser. Provisional No. 60/923,928, filed Apr. 17, 2007.

BACKGROUND OF THE DISCLOSURE a) Field of the Disclosure

This disclosure relates to the field of hand tools, specifically hand tools having a clamping portion similar to traditional pliers.

b) Background Art

Hand tools for gripping material and work pieces are commonly utilized devices which are generally known as pliers. Pliers have been formed in a variety of embodiments in the prior art but generally operate on the principle of having a central pivot member between two plier members. Some prior art pliers have the capability to lock the jaw portion of the pliers without constant interaction of the tool handler.

Locking multi-tools using a member under compression such as that disclosed in U.S. Pat. No. 4,318,316 are also fairly common. Locking plier technology has even been applied to folding multi-tools, such as that disclosed in U.S. Pat. No. 6,006,385. This particular patent discloses a locking multi-tool having a toggle link 70 connected to a handle 16 configured to lock about an object by pressing handles 16 and 18 toward each other.

The most common type of locking pliers are found under the trade mark Vise-Grip™, a Registered Trade Mark of Petersen Mfg., Co.'s locking pliers. Petersen is part of American Tool Companies, Inc. Prior art locking pliers are based upon the general principle of placing some form of a cross-linked member in compression so as to apply stored energy to this cross-linked member whereas when this cross-linked member extends beyond some maximum compression point, the spring stored energy will lock the player handles and more particularly the jaw members to a closed orientation. The operating principle behind Vice-Grips is well-known in the art, and of course utilizes some form of a screw adjustment member to adjust the orientation of the jaw members.

Most individuals who are familiar with hand tools are familiar with locking pliers and are likely well aware of the limitations of locking pliers, such as having to adjust the end jaw regions by way of an extendable member, such as a threaded screw, to make the pliers operational for gripping a material or a plurality of materials which are to be clamped together. This process requires the individual utilizing the locking pliers with a prior art-type compression link member to adjust a screw normally at the longitudinal end base region of one of the plier handle members so as to orientate the pliers at an approximate width location, whereby applying a compressive force between the two handle members will lock the jaws upon the material.

Of course one issue with this arrangement is that the locking pliers are generally not capable of being utilized as a regular set of conventional pliers, for example to quickly clamp upon a variety of sizes of materials without necessarily adjusting the orientation of the compression cross-link member. In other words, conventional pliers having a jaw region, each connected to corresponding handle regions, can open wide and narrow to accommodate a variety of tasks for quickly clamping upon various sized materials such as bolts, rods, etc. However, conventional types of pliers, as well as conventional non-locking multi-tools, generally do not have any sort of locking capability to remain intact upon a material when the handle members are no longer grasped.

Further, the locking member folding tools such as that introduced above in U.S. Pat. No. 6,006,385 utilize the prior art technology of an intervening compression link member and require a plurality of procedures and limitation for utilizing the pliers as a conventional non-locking plier.

A new technology such as the locking plier entitled Auto-Lock distributed by Sears Craftsman discloses a plier which is automatically adjusting with regard to the width of the jaw members, but when tension is applied to the jaw members, an internal mechanism will become substantially fixed to provide a locked point for the compression member to act upon the handles. This design does indeed provide the flexibility of self-adjusting locking pliers, but requires many components and provides a compression member to have the stored energy be supplied therein for locking the jaw members together.

Therefore, as described herein, there is a novel concept of utilizing a linkage member which is in tension and which can apply a closing locking force upon the first and second jaw members. This novel design can be carried out in a plurality of embodiments shown herein wherein the embodiments have different operational benefits depending upon the intended use. In one form, the tool is a multitool where the handle members can fold and be positioned around the jar region for a compact design. In this form, other tool members can be positioned within the handle or both of the handles of the multitool. Other forms are shown herein such as a conventional set of tension pliers which can be foldable or be a fixed type of design.

Further disclosed herein are various adjustment mechanisms to adjust the tension member to accommodate a plurality of sized materials positioned interposed between the first and second jaw members. As will be described further herein, this adjustment system requires an adjustment of the effective portion of the tension member, and in some cases the attachment locations of the tension member with respect to a center locking pivot of the tension member, which will be described thoroughly herein.

SUMMARY OF THE DISCLOSURE

Disclosed herein is in one form a clamping tool having a first jaw with a first clamping face and a first extension. There is a corresponding second jaw having also in one form a second clamping face and a second extension, the second jaw pivotally coupled to the first jaw at a jaw assembly pivot which can be accomplished in a variety of methods, in some forms by an adjustable, movable pivot. A first handle is pivotally attached to the first extension at a first handle pivot in a multi-tool design which is one form of the concept disclosed herein. Further, a second handle is pivotally attached to the second extension at a second handle pivot.

A tension member is attached to the first handle at a first tension attachment location, and attached to the second handle at a second tension attachment location. The tension member is configured to exert clamping force between the first jaw and the second jaw when the tension member is in tension between the first tension attachment location and the second tension attachment location.

In one form the clamping tool operates as a regular pivoting pliers to allow for various widths of material to be interposed between the jaw region and further the clamping tool can operate as a locking mechanism. In other words, the clamping tool can work selectively worked as a regular of pliers having a maximum open position and further as the locking set of pliers.

The tension member can be a flexible member and have various adjustment mechanisms to have the jaw portion adapt to various sized tool pieces fitted therebetween. In one form the first handle has a first side plate, a second side plate, and a back plate extending from the first side plate to the second side plate forming a first channel. The second handle also comprises a first side plate, a second side plate, and a back plate extending from the first side plate to the second side plate forming a second channel. The multipurpose tool is operatively configured to be folded from an operational orientation to a storage orientation wherein the first jaw and the second jaw are positioned substantially within the first and second channel in the storage orientation.

In another form of description, disclosed herein are tension locking pliers operatively configured to lock upon a material. The tension locking pliers have a jaw assembly having first and second jaw members. Each jaw member has a first and second jaw extension connected to a first and second jaw base respectively. The first and second jaw members are pivotally attached at a jaw assembly pivot which can be a fixed pivot or a mobile pivot.

There are first and second handle members attached to the first and second jaw members respectively. Further there is a tension member operatively attached to the first handle member at a rear tension member pivot and to the second handle member at a front tension member pivot. A dead point line is defined by the rear tension member pivot and a rotation point of the second handle where the front tension member pivot of the tension member is configured to reposition past the dead point line to be in a locked configuration.

It should be noted that repositioning the tension member such that the tension member is configured to reposition past the dead point line places tension upon the jaw members to lock the material interposed between the first and second jaw members. Of course these basic definitions can be carried out in a variety of mechanisms as disclosed herein with various examples.

Disclosed and described herein is a tension locking plier assembly configured to grasp a material. The material can be any type of work piece or other object which is desired to be grasped by the tool user. The material can either be temporarily grasped or locked down by the tension locking plier. The tension locking plier assembly has a first plier unit having a first jaw and a first handle. Further there is a second plier unit having a second jaw and a second handle. The second plier unit is attached to the first plier unit so that the first jaw and the second jaw reposition with respect to one another so as to grasp the material of various cross-sectional dimensions.

A tension member is operatively connected between the first plier unit and the second plier unit so the tension member is attached at a first connection location to the first plier unit and attached to a second tension location to a locking member.

The locking member is movably attached to the plier unit about a center locking point so when the first and second jaw members are positioned around the material, the locking lever is in an unlocked orientation and the locking lever is operatively configured to reposition the tension member so as to be positioned past the maximum dead point tension length where the first connection location, the center locking pivot and the second tension location are substantially co-linear so the locking lever is limited in the degree of rotation to maintain tension in the tension member to maintain a locking force upon the material interposed between the first and second jaw members.

Of course the tension locking pliers can be arranged in a variety of forms where the tension member could for example be positioned forward of a pivot attachment location pivotally attaching the first and second pliers units together.

Further the tension locking plier assembly as recited above can be arranged wherein the first connection location is positioned on the first handle and the second connection location is attached to the second handle which is pivotally attached to a second jaw base of the second jaw member and the second handle operates as the locking lever.

The tension locking plier can alternatively be arranged so the tension member is positioned longitudinally rearwardly of a pivot attachment location connecting the first and second plier units together. In this form the first and second handles can be pivotally attached to the first and second jaw members so the jaw members are configured to fold therearound within the chamber region defined between the first and second handles when the tension locking plier assembly is in a stored orientation.

The tension locking pliers can be arranged as a channel lock-like embodiment where the second plier unit is attached to the first plier unit by way of providing an arcuate extension configured to engage one of a plurality of arcuate slots of the opposing plier unit. In this form the effective pivot point of the engagement between the arcuate extension and the arcuate slots provides the center locking pivot of the tension locking plier assembly. The tension member is operatively configured to be positioned at a longitudinally forward portion of a dead point axis defined between the first attachment location of the tension member and the center locking pivot and further configured to reposition longitudinally rearwardly of the other dead point axis when in a locked orientation.

One convenient method of locking the pliers units to the tension member is to have the second tension location attach to the tension member by a first engagement member and a second engagement member positioned on opposing longitudinal sides of the tension member. This allows for a quick release tension member system and the first and second engagement members can have a plurality of teeth that are facing one another, and the first and second engaging members are offset in the transverse direction such that where the plurality of teeth of the first and second engagement members engage correspondingly sized and spaced members of the tension member when in the locked orientation and when the second plier unit is in an unlocked orientation, the first and second engagement members disengage from the teeth of the tension member so as to allow the second plier unit to reposition in the transverse direction.

A tension quick release assembly can be provided where the length of the tension member is adjusted by repositioning a pillow block in the longitudinal direction of the first handle member and first and second engaging members are provided to disengage from a threaded rod so as to allow the pillow block member to freely reposition in a longitudinal direction. Engagement extensions are connected to engagement members positioned between the pillow block providing engagement thereof where a slanted surface maintains engagement of the engaging members to the threaded rod when the pillow block is in tension by the tension member. The first and second engaging members can have a biasing member to bias the first and second engagement members laterally apart from one another away from the threaded rod to allow the pillow block to freely slide along the threaded rod. This arrangement allows for convenient use of the tool as a regular plier and can be applied to a locking tool by engaging the pillow block to the threaded rod. In this form a spring member biases the pillow block longitudinally rearwardly.

In one form a main gear is attached to a threaded rod gear so as to provide a mechanical advantage upon rotating the threaded rod for rotation thereof.

Finally the various tools herein can be described and defined broadly as a first plier unit pivotally attached to a second plier unit at a pivot attachment location. The first plier unit has a first jaw position forward of the pivot attachment location and a first handle positioned rearward of the pivot attachment location. Likewise the second plier unit has a second jaw position forward of the pivot attachment location and a pivot handle attached rearward of the pivot attachment location.

A tension member is attached to a locking member which is attached to the second plier unit at a second tension attachment location. The tension member is further operatively attached to the first plier unit at a first tension attachment location. The locking member is repositionably attached to the second plier unit so as to be rotated about a center locking pivot.

The position of the first tension attachment location, the center locking pivot, and the second tension attachment location upon the locking member can be adjusted so as to accommodate various widths of material to be interposed between the first and second jaws. Further the length of the tension member is adjustable so the adjusted position of the first tension attachment location, the length of the tension member, the location of the center locking pivot, and the location of the second tension attachment location upon the locking member are sufficiently adjustable wherein when the locking member is positioned to an orientation so the second attachment location passes a dead point axis defined by the center locking pivot in the first tension attachment location, there is tension placed upon the tension member. Further the locking member is limited to the amount of repositioning of the second tension attachment location once the second tension attachment location is positioned past the dead point axis.

Of course there are many further details of the various embodiments that are shown herein below.

DESCRIPTION OF THE PREFERRED EMBODIMENTS

This application incorporates by reference U.S. Provisional Ser. No. 69/923,928, filed Apr. 17, 2007.

Figure 1:
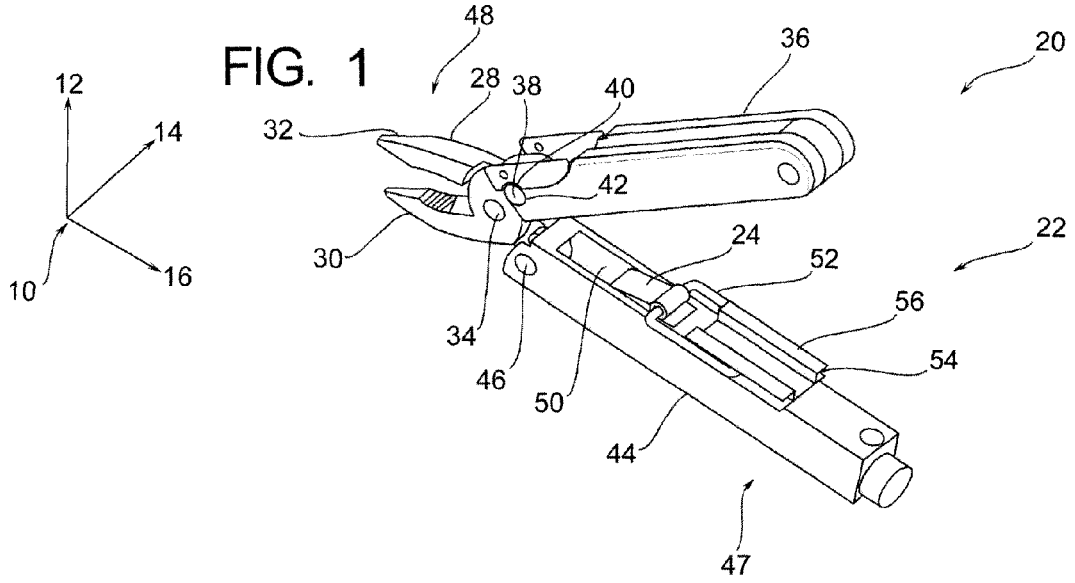
FIG. 1 is an isometric view of one embodiment of the disclosure where the tension member is in a stored position.
Figure 2:
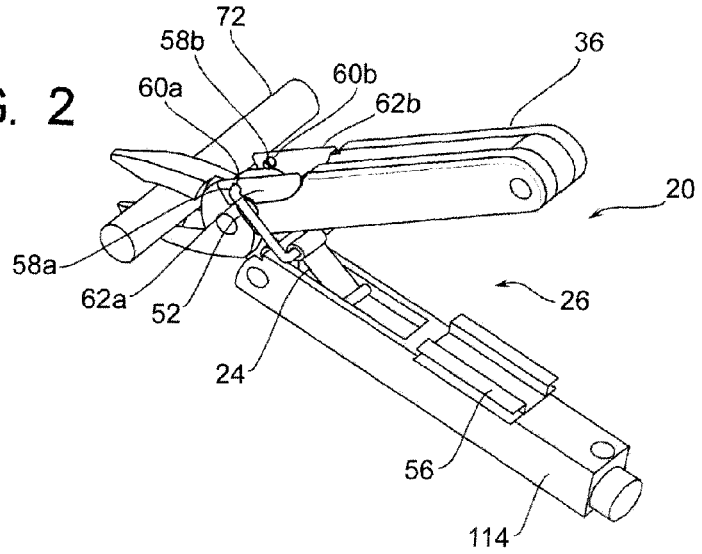
FIG. 2 is an isometric view of one embodiment of the disclosure where the tension member is in an engaged position.

As shown in FIG. 1, there is a locking multitool 20. In general, the locking multitool 20 has the capability of providing a clinching-like locking of the jaw assembly 48 by utilization of a tension member 24 as shown in FIG. 2. By way of general background, locking pliers have been utilized in the prior art, such as traditional Vise-Grip™ pliers which have an intermediate interposed compression locking member utilized to exert an expanding force to lock such prior art jaw assemblies. As will be discussed in detail herein, a combination of the jaw assembly 48 and the handle members 36 and 44 operate in conjunction with a tension member 24 providing an operational tool for locking an object such as the material 72 in FIG. 2 whereby the jaw assembly 48 will remain locked upon the object without any external force upon the locking multitool 20.

Figure 7:
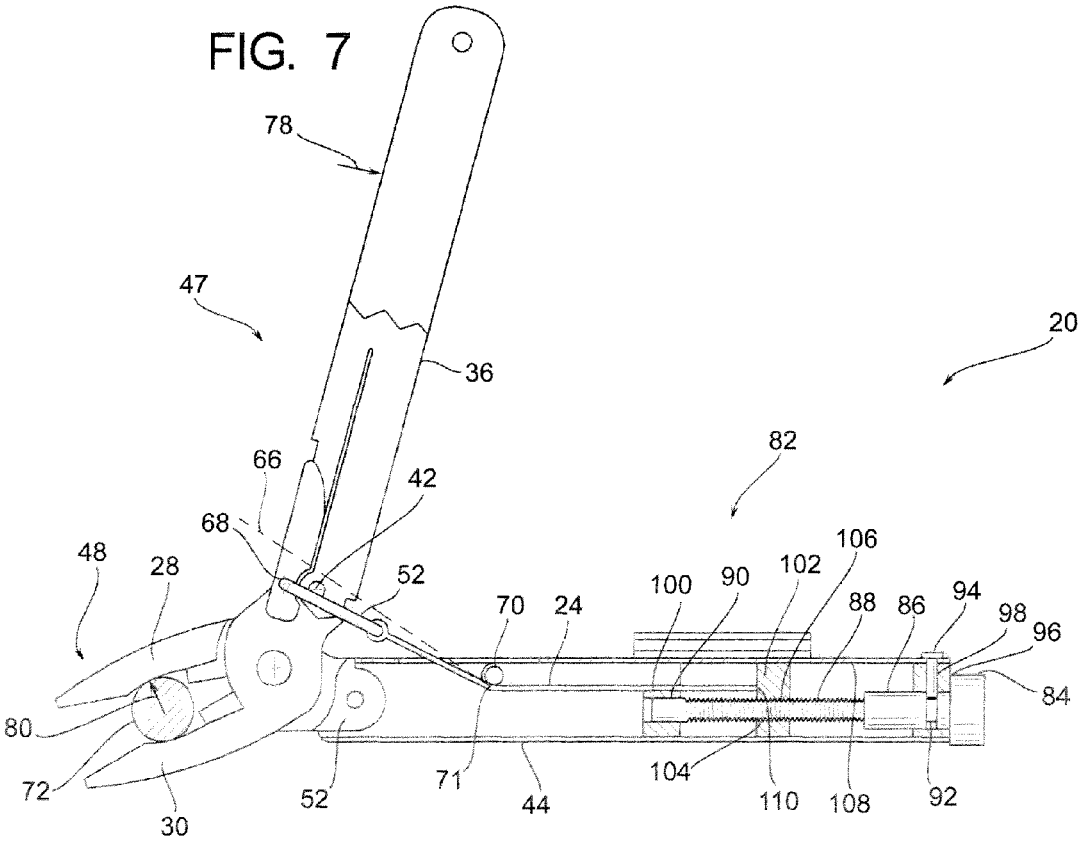
FIG. 7 is a side view, partially cutaway to show the mechanism, of one embodiment of the disclosure where the tension member is attached in the engaged position and the locking handle is in a pre-locked orientation.

The basic operating premise of the tool can be seen in FIG. 7 wherein the second handle 36 can rotate about the pin 42 with respect to the second jaw 30. Therefore, it can be appreciated that when the second handle 36 is repositioned to a position a shown in FIG. 8, the front tension member pivot 68 repositions past center and to the right of the tension member pivot 70 and the jaw pivot 38. Basically, a dead point line 66 as shown in FIG. 9 is defined between the approximate pivot point at the bottom portion of the rear tension member pivot 70 and the second jaw pivot 38.

Figure 13:
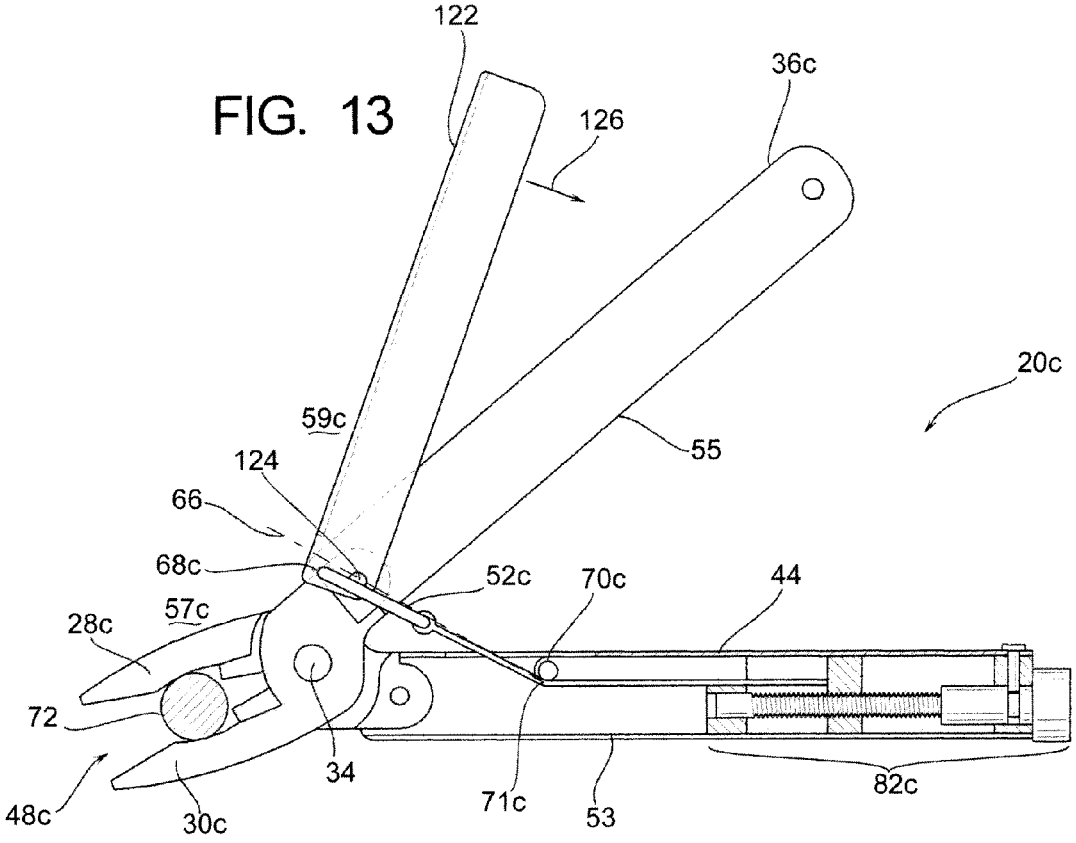
FIG. 13 is a side view, partially cutaway to show the mechanism, of one embodiment of the disclosure where the tension member is attached in the engaged position.

Of course as described herein, this basic operating principle is shown in a plurality of embodiments, such as with a second outer handle 122 as shown in FIG. 13 as well as a non-folding tool design in a plurality of other forms. With the foregoing general description in place to establish a basic understanding of the operating principle of the locking multitool, there will now be a detailed description of the first embodiment with reference to FIGS. 1-9.

Prior to further technical disclosure, an axes system 10 is shown in FIG. 1 having a lateral axis 12, a transverse axis 14, and a longitudinal axis 16. The axis system generally indicates directional relationships and is not necessarily confined to the components to these directions and is of course not necessarily comprised of perfectly orthogonal directions.

As shown in FIG. 1, there is a locking multitool 20 of a first embodiment shown in a stored configuration. In this configuration, the tension member 24 is not engaged with the second handle 36, and the locking multitool 20 operates as a conventional set of pliers. FIG. 2 shows the same locking multitool 20 in an engaged configuration, wherein the tension member 24 is engaged with the second handle 36, and the locking multitool 20 operates as a locking set of pliers. As described further herein, an engaged position is further defined to include having the tension member on any sort of a locking member/lever such as the embodiment shown in FIG. 13.

Figure 3:
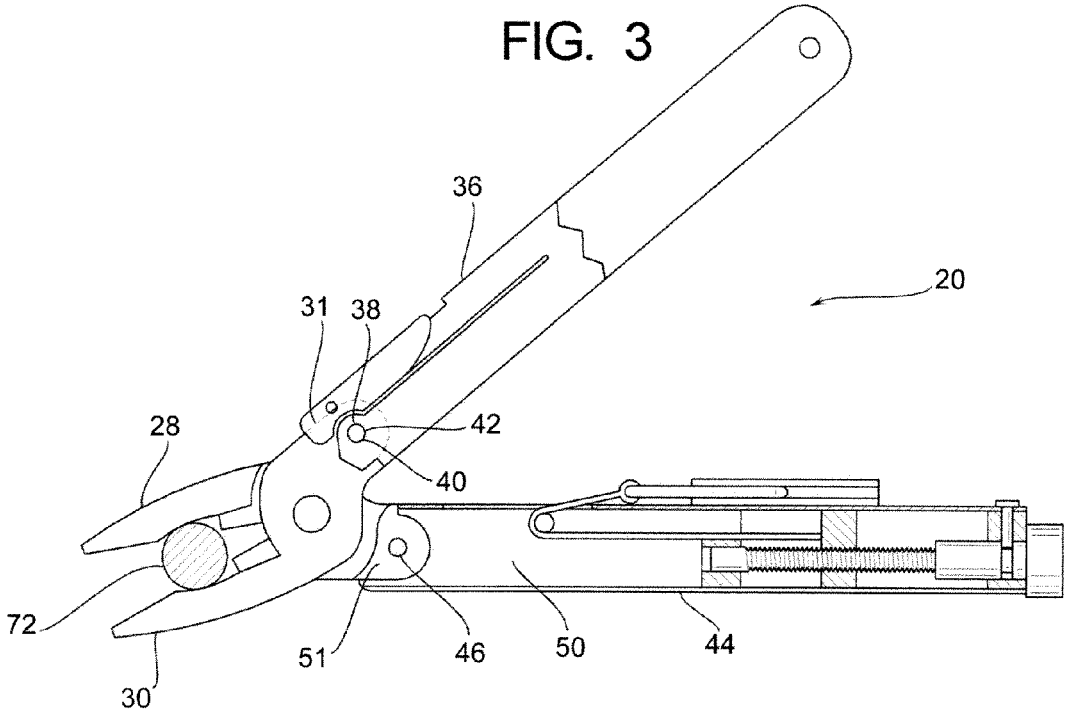
FIG. 3 is a side view, partially cutaway to show the mechanism, of one embodiment of the disclosure where the tension member is in a stored position.

As is further shown in FIG. 1, the multitool 20 generally comprises a jaw assembly 48 and a handle portion 47. A jaw assembly 48 comprises a first jaw 28 and a second jaw 30, extending toward a longitudinally forward end 32 of the locking multitool 20. The first jaw 28 and second jaw 30 are rotatably connected to each other at jaw assembly pivot 34. The second jaw 30 includes a portion 31 which extends partially into the second handle 36 (as seen in FIG. 3) and is connected to the second handle 36 at the second jaw pivot 38. The second jaw pivot may be formed of a pin 42 disposed within a plurality of surfaces defining openings 40 in the transverse right and transverse left portion of the second handle 36. Similarly, a surface defining an opening may be provided in the second jaw 30 at the second jaw pivot 38 which will allow for a pin 42 to be disposed within the opening 40, creating a pivot which will allow the locking multitool 20 to fold such that the first jaw 28 resides partially within the second handle 36. Similarly, the first jaw 28 is coupled to the first handle 44 at the first handle pivot 46. This will allow the second jaw 30 to pivot about the first handle pivot 46, and partially be stored within the first handle 44. There are a plurality of ways of pivotally connecting the handle to the corresponding jaw member. In one form of a foldable multitool, the handles fold around the jaw assembly, and in other forms the jaws could, for example, fold and be slidably repositioned directly within the handle portion 47. As described further herein, the handles can be utilized as a locking lever in conjunction with the tension member.

Figure 2A:
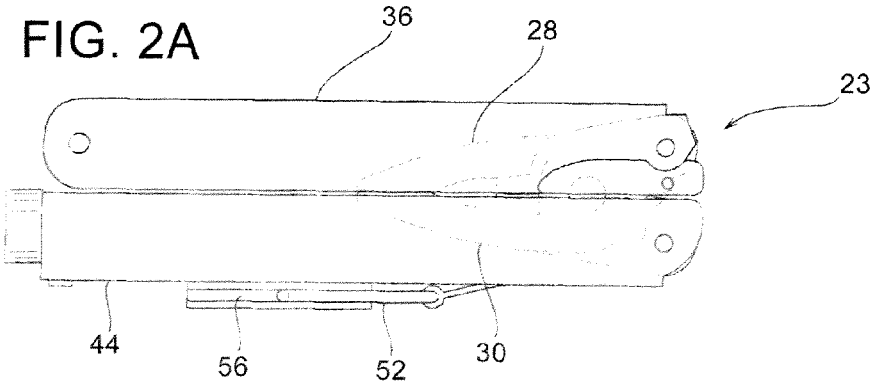
FIG. 2A is a side view of one embodiment of the disclosure in a closed position.

FIG. 2A shows the tool in a closed configuration 23 wherein the first jaw 28 is substantially within the second handle 36 and likewise the second jaw 30 is substantially within the first handle 44. When in the stored configuration as shown in FIG. 1, the jaw assembly 48 is operated by opening and closing the first jaw 28 in relation to the second jaw 30. To utilize the multitool 20 as a standard set of pliers, the frictional coefficient at the jaw assembly pivot 34 should be less than the frictional coefficient at both the first handle pivot 46 and the second jaw pivot 38. This is accomplished as there is sufficient frictional force between the opposing interior wall of the interior wall 50 (see FIG. 3) of the first handle 44, and the exterior surface 51 of the first jaw 28. A similar correlation is utilized between the second handle and in the second jaw.

Figure 8:
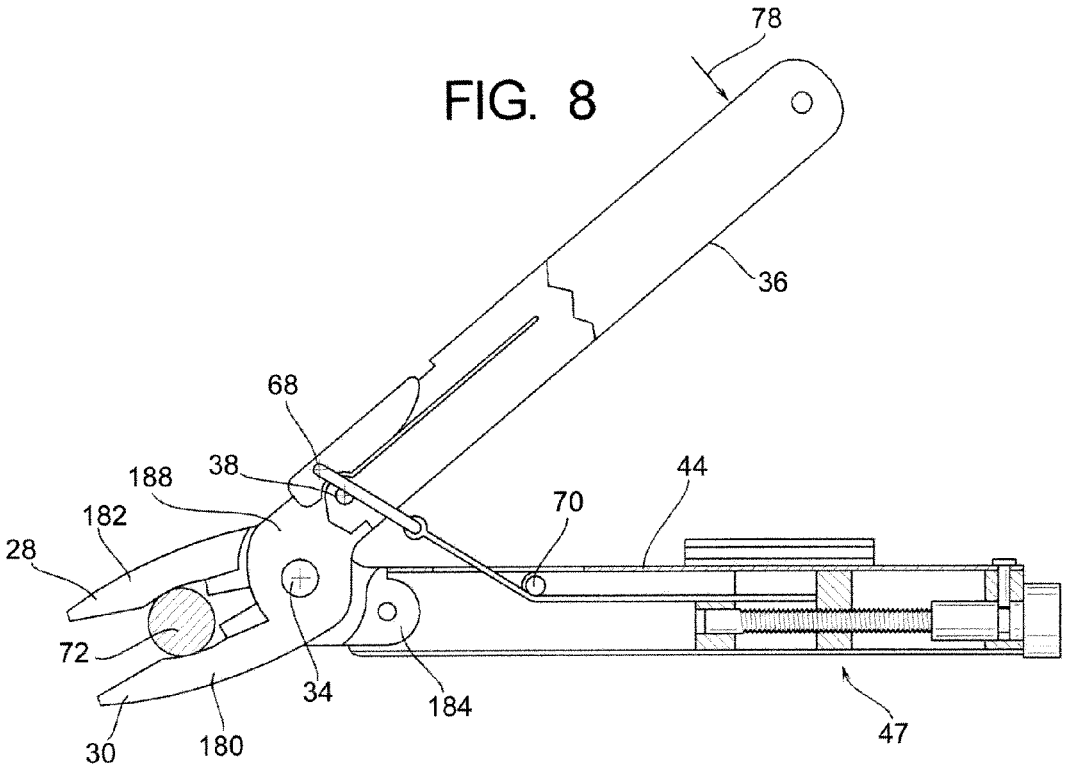
FIG. 8 is a side view, partially cutaway to show the mechanism, of one embodiment of the disclosure where the tension member is attached in the engaged position and the locking handle is in a locked orientation.
Figure 9:
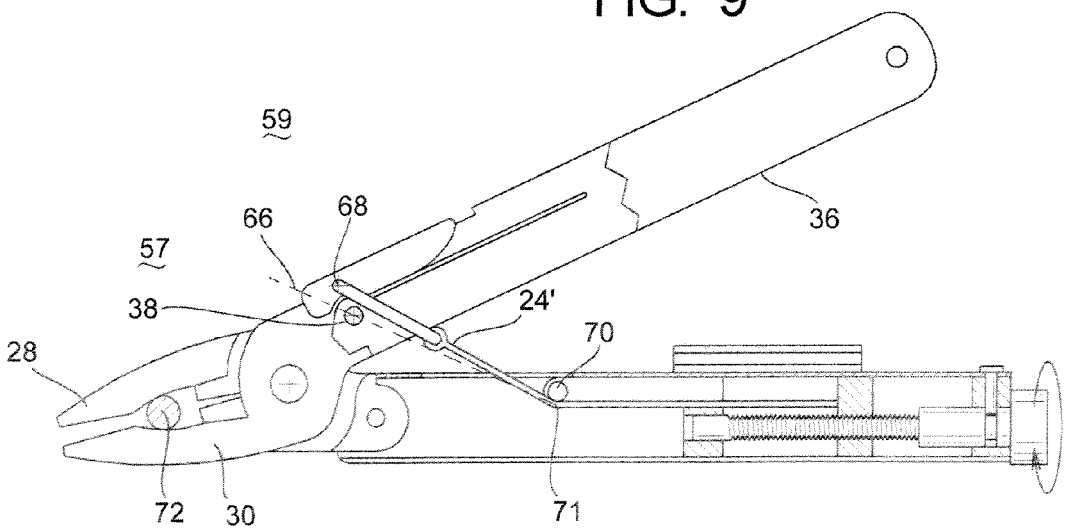
FIG. 9 is a side view, partially cutaway to show the mechanism, of one embodiment of the disclosure where a smaller tool piece is grasped in the jaw assembly.

As shown in FIG. 8, the first and second jaws 28 and 30 each comprise a jaw extension region in the jaw base region. FIG. 8 shows the first jaw extension 182 connected to the first jaw base 184. In one form the jaw extension and jaw bases are a unitary structure comprising the jaw member. In a like manner, the second jaw member 30 comprises a second jaw extension 186 which is in connection with the second jaw base 188. In one form, the jaw assembly pivot 34 is an integral structure with one of the jaw members or as a separate pin attached therethrough. As is well understood in the art of pliers, the torque is generally applied to the jaw bases 184 and 188, thereby transferring rotational torque to the jaw extensions 182 and 186.

In general the handle portion 47 comprises the first and second handles 44 and 36. These handles can have substantially similar functionality as folding multi-tools, for example as described in U.S. Pat. Nos. 4,238,862 and 5,957,013, which are both incorporated by reference. As shown in FIG. 7, the adjustment mechanism 82 occupies space within the first handle 44; however, in other forms, the adjustment mechanism can be repositioned in a manner so as to allow tools to be positioned therein.

Referring back to FIG. 1, the tension member 24 terminates in a clip 52, which is stored within a slot 54 of a storage member 56. This clip storage member 56 prevents the clip 52 and tension member 24 from interfering with operation of the locking multitool 20, when the tool is used as a standard set of pliers when the tension member 24 is in the standard configuration 22. The locking multitool may also consist of a tension member 24 which is not removable from the first handle 36 in one form.

Figure 4:
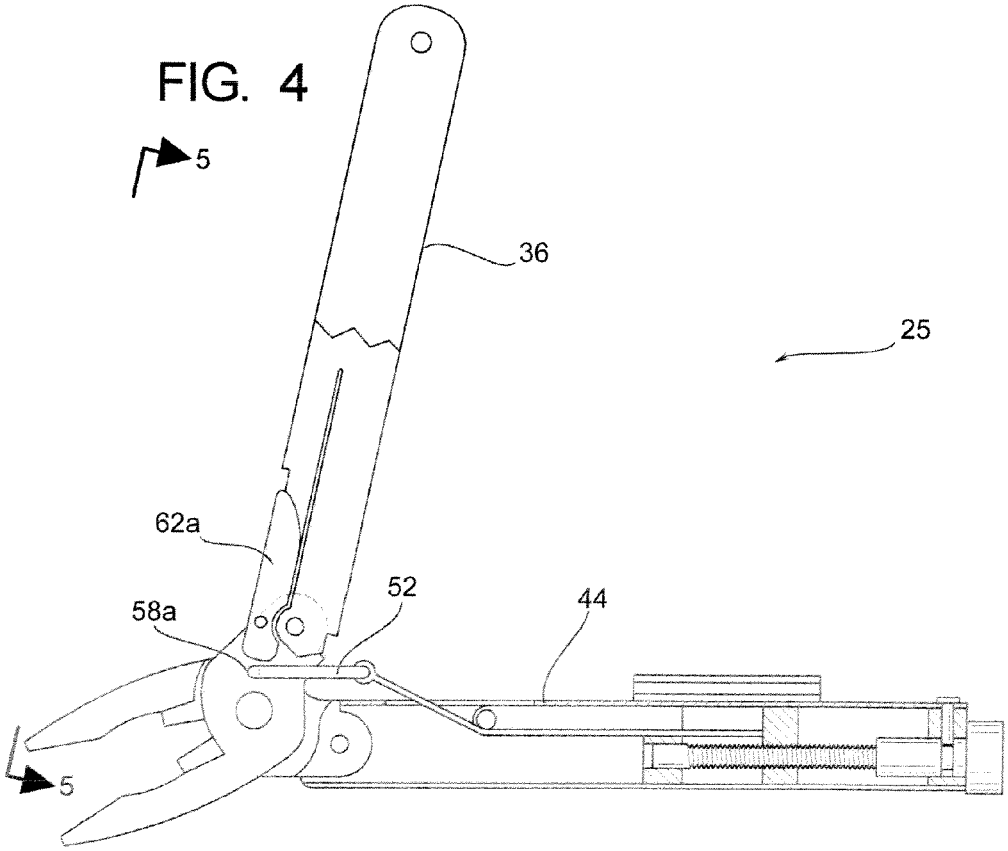
FIG. 4 is a side view, partially cutaway to show the mechanism, of one embodiment of the disclosure where the tension member is in an engaged position.
Figure 5:
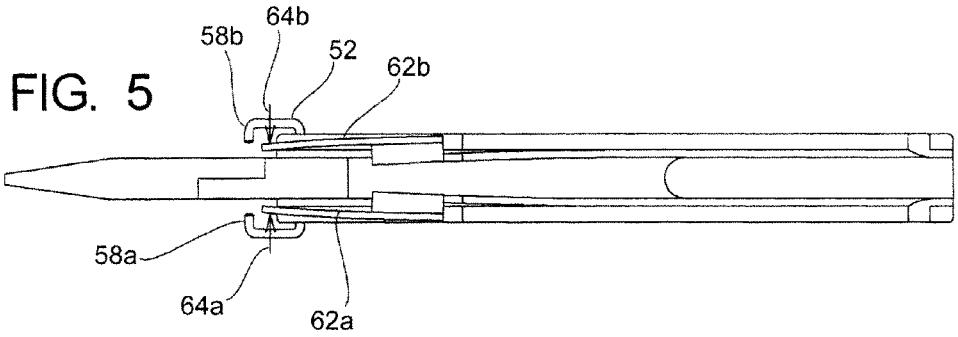
FIG. 5 is a plan view of one embodiment of the disclosure where the tension member is shown in transition from or to the engaged position.
Figure 6:
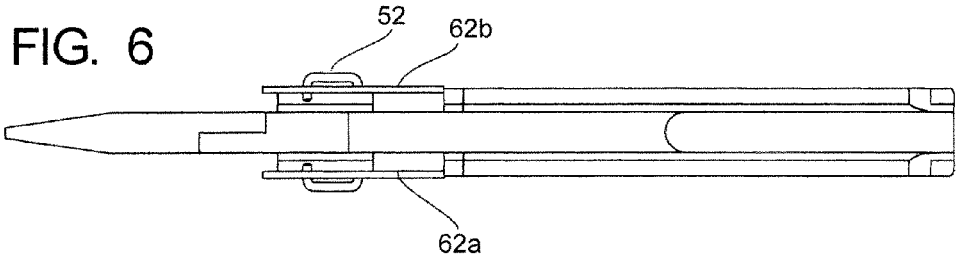
FIG. 6 is a plan view of one embodiment of the disclosure where the tension member is attached in the engaged position.

As shown in FIG. 2, the locking multitool 20 can be reconfigured to an engaged configuration 26 by removing the clip 52 from the clip storage member 56 and engaging the left extension 58*a* of the clip 52 within the left opening 60*a* of the left leaf spring 62*a*. Similarly, the clip 52 is attached via a right extension 58*b*, by positioning the right extension 58*b* within the right opening 60*b* of the right leaf spring 62*b*. The left leaf spring 62*a* and right spring 62*b* are configured to be temporarily positioned towards each other to allow passage of the clip 52 as shown in FIGS. 4 and 5 such that the left extension 58*a* and right extension 58*b* can be positioned within the right openings 60*a* and 60*b* respectively. FIG. 5 shows how the right leaf spring 62*b* is temporarily repositioned in direction of travel 64*b* towards the left leaf spring 62*a*. Similarly, the left leaf spring 62*a* is pressed in direction of travel 64*a* towards the right leaf spring 62*b*. Once the right and left leaf springs are sufficiently repositioned, the right extension 58*b* and left extension 58*a* can be positioned adjacent to the left and right openings 60*a* and 60*b*, wherein the right and left leaf springs are released, capturing the clip 52 as shown in FIG. 6.

For ease in understanding of the locking operation of this disclosure, an imaginary line called a "dead point line" 66 (see FIG. 9) drawn between the center locking pivot 38 and the first tension attachment location 71 is disclosed. Referring now to FIG. 7, it can be seen how the jaw assembly 48 is positioned about a piece of material 72, such as a tool piece or a rod. The clip 52 is attached to the second handle 36, and as previously described engages the tension member 24 to the second handle 36. In this first position, force is exerted upon the material 72 by the jaw assembly 48; however, as force is exerted upon the second handle 36 in direction of travel 78, the second handle 36 is repositioned toward the second position (otherwise referred to as the locking position), as shown in FIG. 8 the dead point line is substantially in line with the second jaw pivot 38. The second handle 36 can further be repositioned to a position as shown in FIG. 9. In this position, the front tension member pivot 68 is positioned past the dead point line 66, which causes stability of the apparatus in this third position 76 for locking a smaller tool piece as shown in FIG. 9.

Referring still to FIG. 9, it can be appreciated that the dead point line 66 is defined by the position of the effective portion 24' of the tension member between the first tension attachment location 71 and the second jaw pivot, which in this case is the center locking pivot 38. Of course, in other embodiments (see FIG. 13) the dead point line is defined between the first tension attachment location 71 and the outer handle pivot/center locking pivot 124, which may or may not coincide in location with the pivot attachment of the second handle 36. It should be noted that the dead point line does not unnecessarily begin at the center point of the rear tension member pivot 70, but rather the effective center of tension pull along the effective portion of the tension member 24'. The effective portion 24' is the portion of the tension member which supplies the locking force and the locking force direction between the two handles. For example, as shown in FIG. 9, the portion 24" of the tension member happens to be along the longitudinal axis of the first handle 44; however, as far as the operation of the kinematics between first and second handle for the tension locking assembly 21, the length and angle of the section 24" does not have a significant impact upon the locking mechanism where the effective portion of the tension member 24' is of primary importance for proper length, angle and position of the various contact points to allow proper locking of the material 72.

In the first position 73 of FIG. 7, force exerted in direction 78 upon the second handle 36 causes the second handle to operate as a first class lever pulling against the tension member 24 and utilizing the second jaw pivot 38 as a fulcrum. This lever force will reach its maximum at the second position 74 and then, if properly adjusted, slightly release as the front tension member pivot 68 passes beyond the dead point line 66. Thus a user could release pressure upon the second handle 36 and the material 72 would remain grasped by the jaw assembly 48.

The material 72 as shown in FIGS. 7-9, which is positioned between the jaw members 28 and 30, can be of a variety of sizes and could of course be two or more separate items clenched together. This adjustment mechanism 82 as shown in FIG. 7 comprises a thumbscrew 84, which is coaxial with a rod portion 86 and a threaded rod 88, terminating in a non-threaded portion 90. A groove 92 may be provided in the rod portion 86 to retain the thumbscrew 84 in a proper longitudinal position. A retaining portion 94 may be provided, which engages the groove 92 and maintains the position of the rod portion 86. This retaining portion 94 may be kept in place by a block or plurality of blocks 96, and the retaining portion 94 is positioned within a chase 98. The non-threaded portion 90 may be set within a pillow block 100 or similar device. A sliding block 102 is provided having a circular opening 104 and threads 106 configured to engage the threaded rod 88. Thus as the thumbscrew 84 is rotated, the sliding block 102 moves longitudinally along the interior surface 108 of the first handle 44. As the tension member 24 is attached to the sliding block 102 at an attachment point 110, the effective length of the tension member (defined as the distance between the rear tension member pivot 70 and the front tension member pivot 68) adjusts for materials 72 having different diameters 80. This operates similar to the tools commonly known as Vise-Grips™, with one significant difference being that the tension member 24 is under tension, whereas Vice-Grips use a member under compression. One advantage of a flexible tension member 24 is that storage of the tension member 24 is much easier as shown in FIG. 1. Utilizing a flexible tension member rather than a rigid compression member results in significant overall weight reduction of the entire locking multitool 20 over prior compression member tools.

Therefore, the dead point axis is defined as the maximum tension point of the effective portion of the tension member 24' for a given jaw plier assembly width to have a maximum dead point tension length of the tension member. It can be generally appreciated that the second tension attachment location 68 is positioned in a locked region 59, which is defined in this case in FIG. 9 as the portion to the right of the dead point axis 66 whereas the unlocked region as indicated at 57 is to the left of the dead point axis 66. Of course the terms right and left are merely for reference, with respect specifically to FIG. 9 where the locked region is defined as repositioning the locking member/lever (in this embodiment the handle 36) so in some form the tension member is past the dead point axis 66 and the locking lever limits the amount of rotation therepast so the tension in the effective portion of the tension member 24' operates with two functions. One is to hold the locking lever in the closed position where the slight amount of lost potential energy of the rotation past the dead point axis maintains the locking lever in a locked orientation, and secondly, the tension in the tension member maintains a closing force upon the first and second jaw members 28 and 30 to keep the material 72 clasped therebetween. As described herein such as with reference to FIGS. 42 and 43, the locked and unlocked regions 57 and 59 are relative to the position of the various components.

Figure 4A:
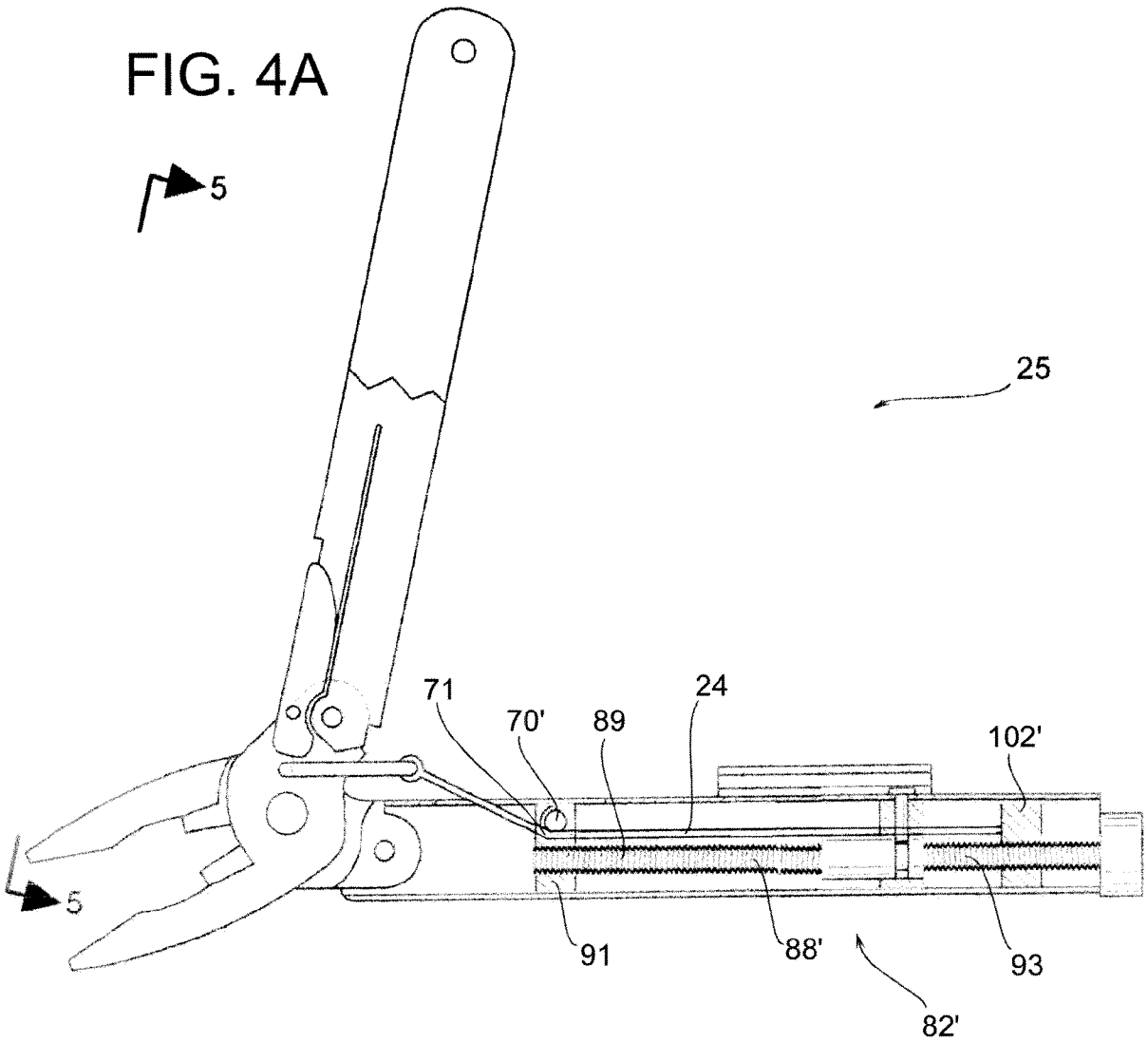
FIG. 4A shows another embodiment where a double-threaded screw is shown to reposition the first attachment location of the tension member.

As shown in FIG. 4A, there is another embodiment where the adjustment mechanism 82' is such that the threaded rod 88' is designed in a manner to have a dual threaded portion wherein the threaded portion 89 is movably attached to the block 91 so as to reposition the rear tension member pivot 70'. The portion 93 of the tension member 88' operates in the previous manner to reposition the block 102'. Therefore, it can be appreciated that as the threaded rod is rotated, the block 102 will move and reposition in one direction pursuant to the thread pitch of the portion 93 of the threaded rod, and the block 91 will move in, for example, an opposing direction due to the thread pitch 89. In general, when the slack is taken up within the tension member 24, for example to grasp a smaller tool piece, this means the jaws are closed and hence the first tension attachment location 71 should be repositioned from a forward position to reposition a formed virtual dead point axis closer to the second tension attachment location of the tension member.

Figure 10:
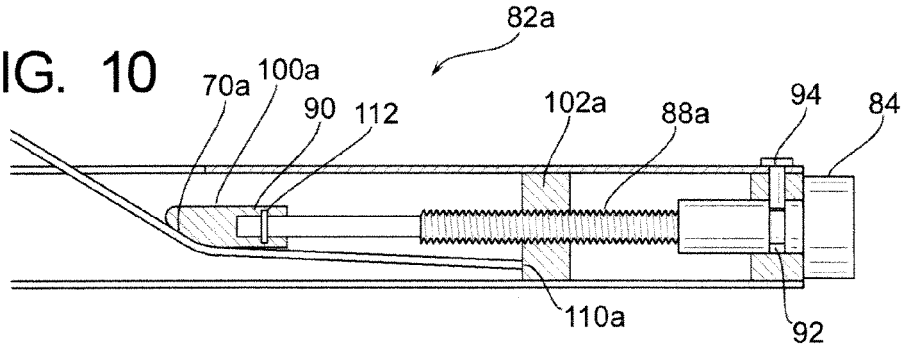
FIG. 10 is a side cutaway detail view of one embodiment of the adjustment mechanism.

Now looking at FIG. 10, another embodiment of the adjustment mechanism 82*a* is disclosed. Several elements of this embodiment are similar to those of FIG. 7, including the thumbscrew 84, the groove 92, and the retaining portion 94. However, in this embodiment the attachment point 110*a* in this embodiment is positioned laterally below the threaded rod 88*a*. The pillow block 100*a* not only operates to maintain position of the non-threaded portion 90 of the rod, but also functions as the rear tension member pivot 70*a*. Thus as the sliding block 102*a* is repositioned longitudinally, the effective length of the tension member (defined as the distance between the rear tension member pivot 70*a* and the front tension member pivot 68) adjusts in relation to the diameter 80 of the material 72 to be gripped. A keeper 112 can be positioned about the threaded rod 88*a* to maintain the position of the threaded rod 88*a* within the pillow block 100*a*.

Figure 11:
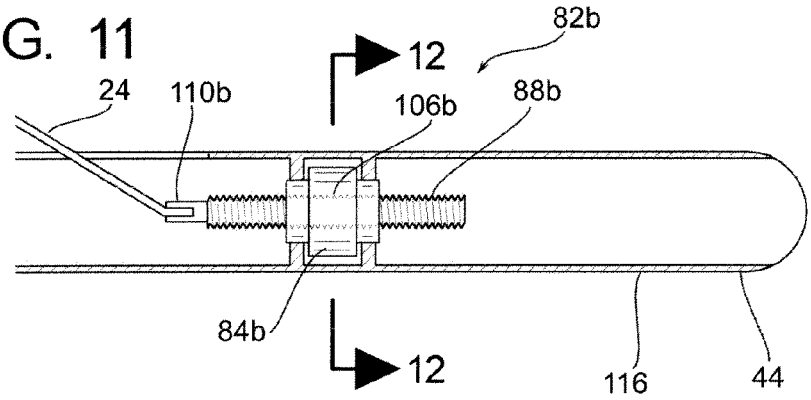
FIG. 11 is a side cutaway detail view of one embodiment of the adjustment mechanism.
Figure 12:
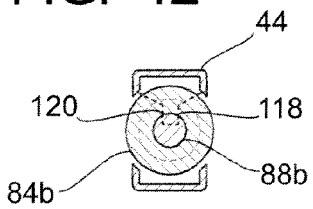
FIG. 12 is a cutaway view taken along line 12-12 of FIG. 11.

Another embodiment of the adjustment mechanism 82*b* is disclosed in FIG. 11. In this embodiment, the threaded rod 88*b* is rotated by a thumbscrew 84*b*, which can project either from the side 114 (see FIG. 2) or bottom 116 of the first handle 44. As the screw 84*b* is rotated, threads 106*b* within a central threaded opening of the thumbscrew 84*b* engage the threaded rod 88*b*. A groove 118 (see FIG. 12) provided on the threaded rod 88*b* engages an extrusion 120 extending from the handle 44, which prohibits rotation of the threaded rod 88*b*. Thus as the thumbscrew 84*b* is rotated, the threaded rod 88*b* repositions longitudinally and does not substantially rotate. As the tension member 24 is attached to the threaded rod 88*b* at the attachment point 110*b*, the effective length of the tension member is adjusted as previously discussed. While a rear tension member pivot 70 is not shown in FIG. 11, one could be added as disclosed in other embodiments.

In another embodiment of the adjustment mechanism 82 (not shown), a gear system is provided which increases or decreases the rotation speed of the threaded rod in relation to the thumbscrew. Such a gear system may be utilized to increase the speed at which the sliding block repositions or alternatively may increase the torque applied to the threaded rod, as described herein.

Figure 14:
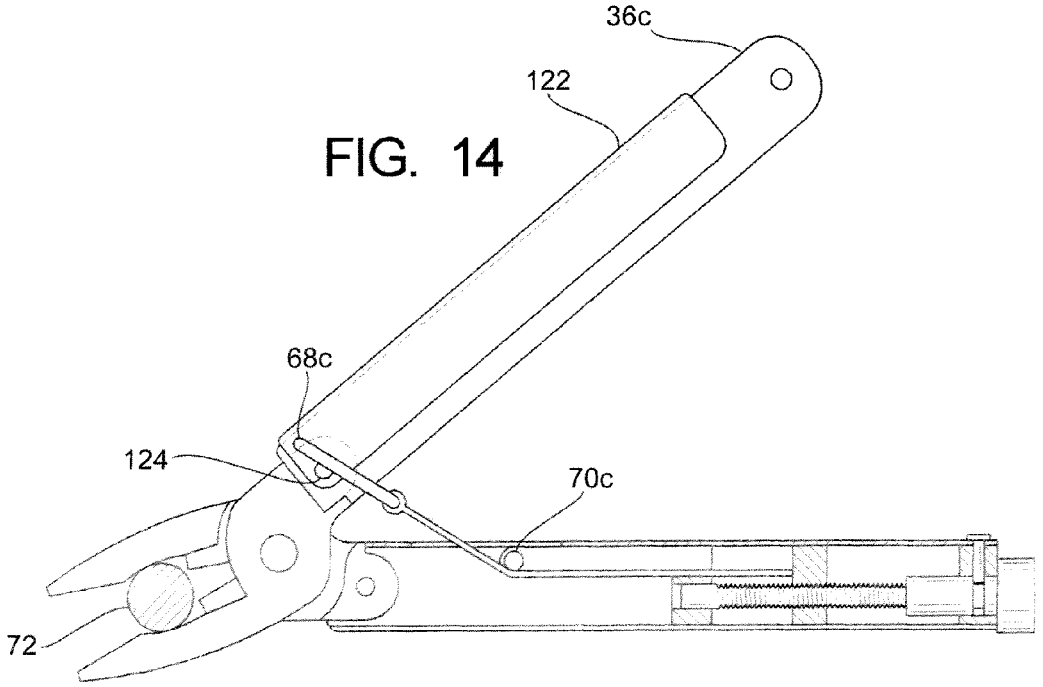
FIG. 14 is a side view, partially cutaway to show the mechanism, of one embodiment of the disclosure where the tension member is attached in the engaged position to a locking handle which is a separate handle from the second handle.

Another embodiment of the locking multitool 20 is shown in FIGS. 13 and 14 where elements similar to those previously described include the suffix "c". In this embodiment, the clip 52, rather than attaching directly to the second handle 36*c* as previously described, attaches to a locking member/outer handle lever 122, which is pivotally attached to the second handle 36*c*. The outer handle 122 is pivotally attached to the second handle 36*c* by an outer handle pivot/center locking pivot 124. In this embodiment, a jaw assembly 48*c* is positioned against the material 72 to be clamped, and then the adjustment mechanism 82*c* is adjusted. Force is then exerted upon the outer handle 122 in the direction as shown at 126, which will reposition the outer handle 122 from the position as shown in FIG. 13 to a position substantially adjacent to the second handle 36*c* as shown in FIG. 14, locking the material 72 in place. As shown in FIG. 13, the front tension member pivot 68*c* is forward of the dead point axis 66 drawn between the center locking pivot 124 and the first tension attachment location 71*c* near the pivot 70*c*. As the outer handle 122 is forced toward the second handle 36*c*, the front second tension attachment location pivot 68*c* is repositioned past the dead point axis 66 to the locked region 59*c* and is then set in a locked position as shown in FIG. 14. In this locked position the material 72 will continue to be held by the tool without continued pressure exerted upon the handle by a user. The outer handle 118 will operate as a first-degree lever, pulling the outer handle pivot 68*c* toward the rear tension member pivot 70*c* with more force than could be exerted if the second handle 36*c* were used alone.

Figure 40:
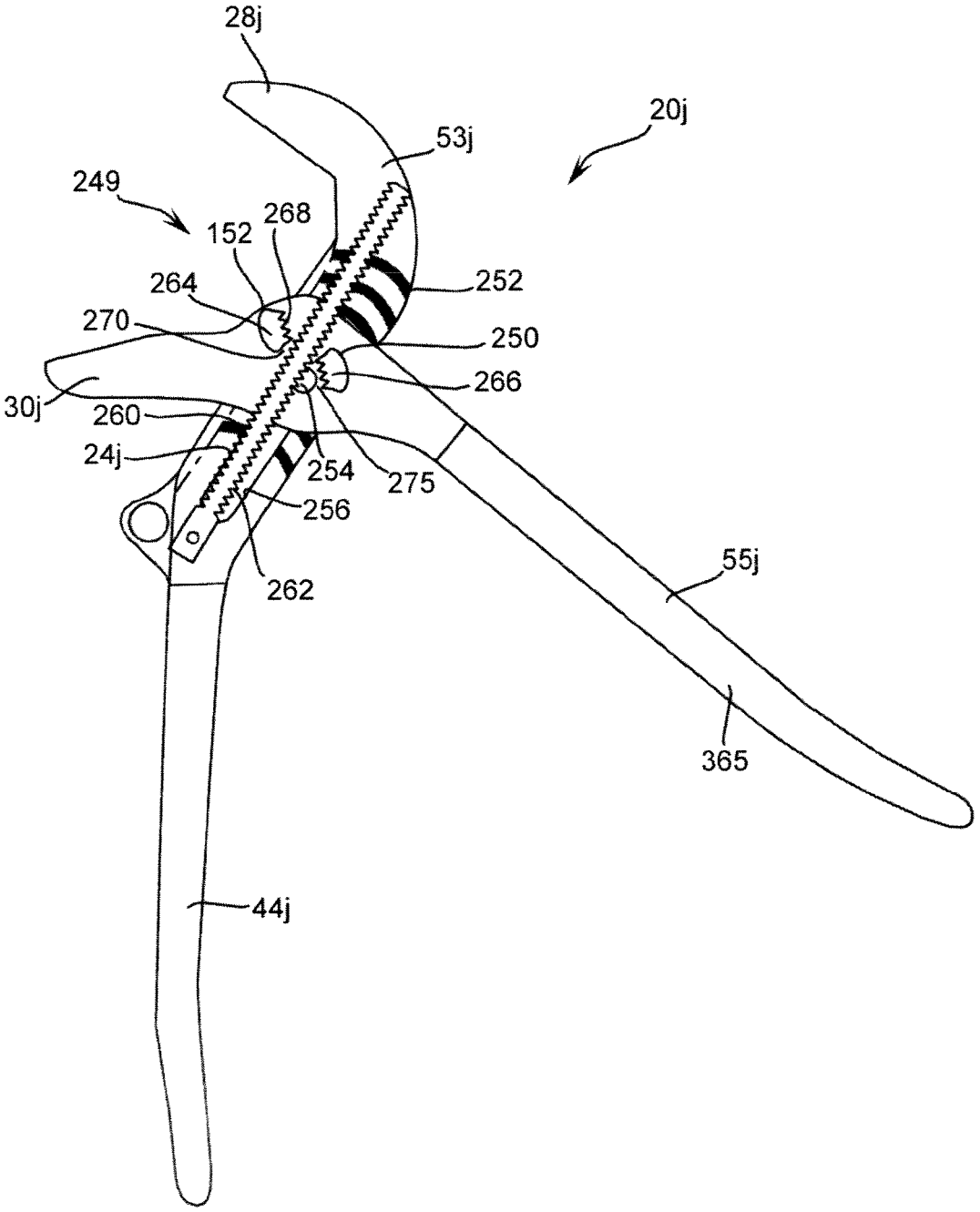
FIG. 40 shows yet another embodiment of a channel lock-like technology coupled with a locking tension member where the channel locks are in an open orientation.

As shown in FIG. 13, it should be noted that for purposes of definition of the embodiments, the first plier unit 53 is defined as the first jaw 28 in conjunction with the first handle 44. Further, the second plier unit 55 in like manner is comprised of the second jaw 30 and the second handle 36. Therefore, the plier units are in general pivotally attached to one another at the jaw assembly pivot 34, but as described herein can be attached in creative manners, as shown in FIG. 40 as well as 44 as described further herein.

Therefore, with the above general description in place, it can be appreciated that the basic premise of the tension locking device as shown in the previous embodiments is to reposition the second tension attachment location of the effective portion of the tension member past the dead point axis. In one form, a locking member such as the outer handle 122 as shown in FIG. 13 or the second handle 36 as shown in FIG. 7 can be utilized, but in other forms, this locking can occur from, for example, a biasing member which repositions the second tension attachment location from the unlocked orientation to a locked orientation from (for example) instead of a first-class lever, a tension device attached somewhere along the second handle which places the second attachment location of the tension member sliding over a cam-like hump surface. Of course, other forms of providing such a locking system could be employed, and additional embodiments are now disclosed herein.

Figure 15:
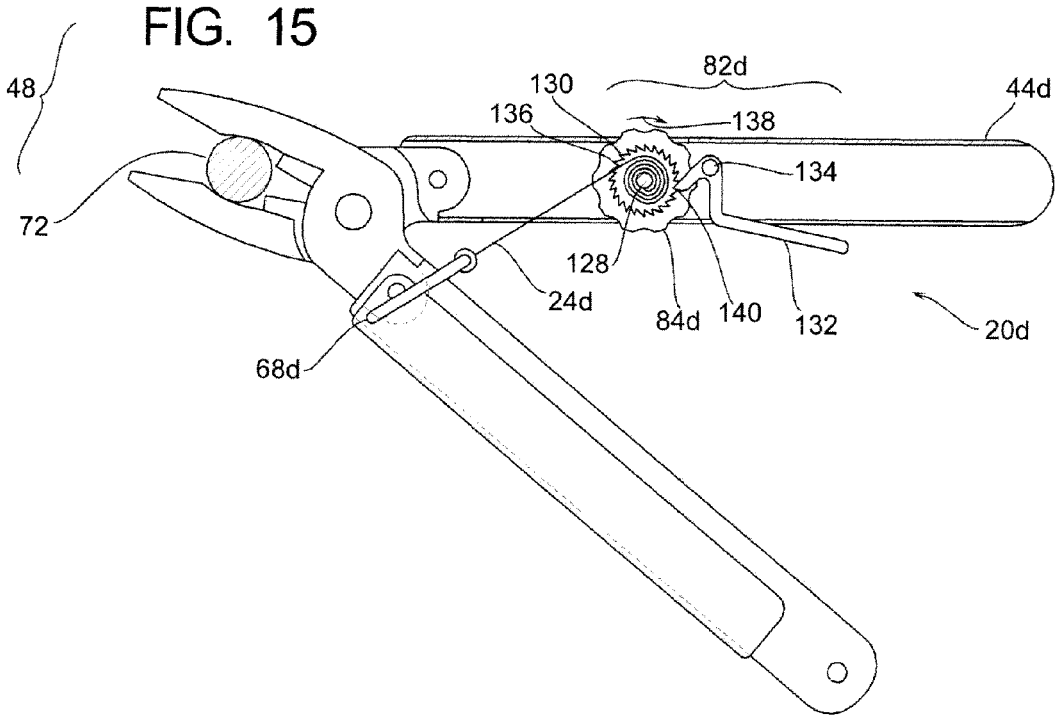
FIG. 15 is a side view, partially cutaway to show the mechanism, of one embodiment of the disclosure where the tension member is attached in the engaged position.
Figure 16:
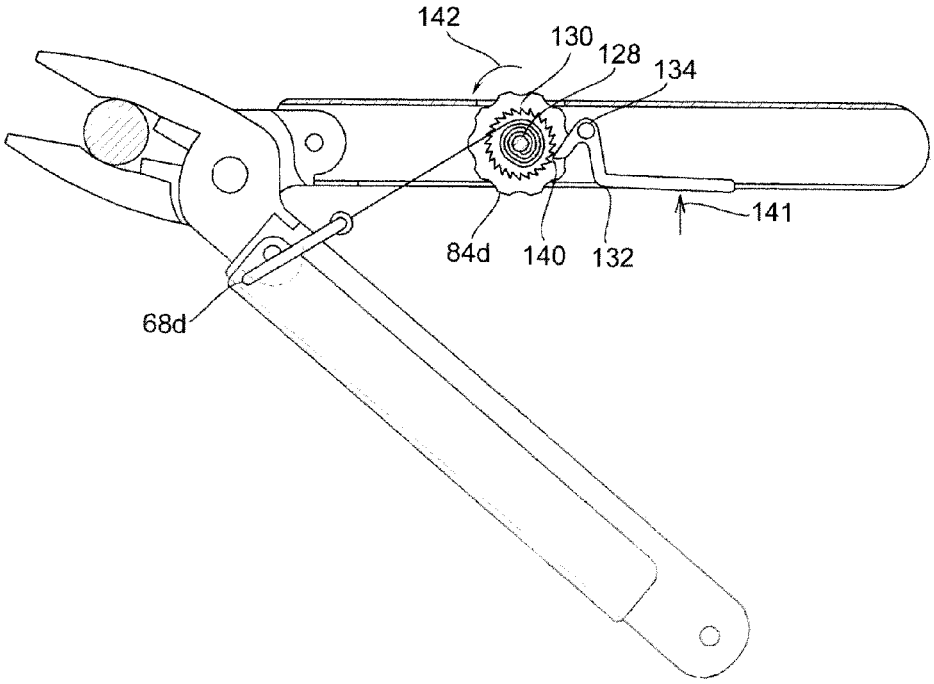
FIG. 16 is a side view, partially cutaway to show the mechanism, of one embodiment of the disclosure where the tension member is attached in the engaged position.

Referring now to FIG. 15, an embodiment is shown wherein the adjustment mechanism 82*d* comprises a thumbscrew 84*d* having a lateral axis. This view of the locking multitool 20*d* has been rotated about a longitudinal axis such that the first handle 44*d* is in the upper position. The thumbscrew 84*d* rotates about an axle 128 which is coupled to the first handle 44*d*. Centered about the axle 128 is also a ratchet gear 130 which allows the tension member 24*d* to be adjusted for material 72 having different diameters. A release lever 132 is also coupled to the first handle 44*d* and allowed to pivot about a release lever pivot 134. The release lever 132 also has a locking point 140 configured to engage a plurality of teeth and grooves 136 disposed upon the radially outward surface of the ratchet gear 130. As the thumbscrew 84*d* and attached apparatus are rotated in the direction as indicated at 138, the locking point 140 sequentially engages the teeth 136, and the effective length of the tension member 24*d* is adjusted between the axle 128 and the tension member pivot 68*d*. The release lever 132 could also consist of a spring member configured to keep the release lever 132 in a position as shown in FIG. 15, wherein the locking point 140 maintains pressure against the ratchet gear 130. This may be accomplished by a piece of spring steel, a spring, including a coil spring disposed between the release lever pivot 134 and the release lever 132. When force is exerted upon the release lever 132 as shown in FIG. 16 in direction 141, the release lever 132 pivots about the release lever pivot 134 such that the locking point 140 disengages from the ratchet gear 130, allowing the thumbscrew 84*d* to rotate in a direction as shown at 142, which will increase the effective length of the tension member between the axle 128 and the tension member pivot 68*d*.

Figure 17:
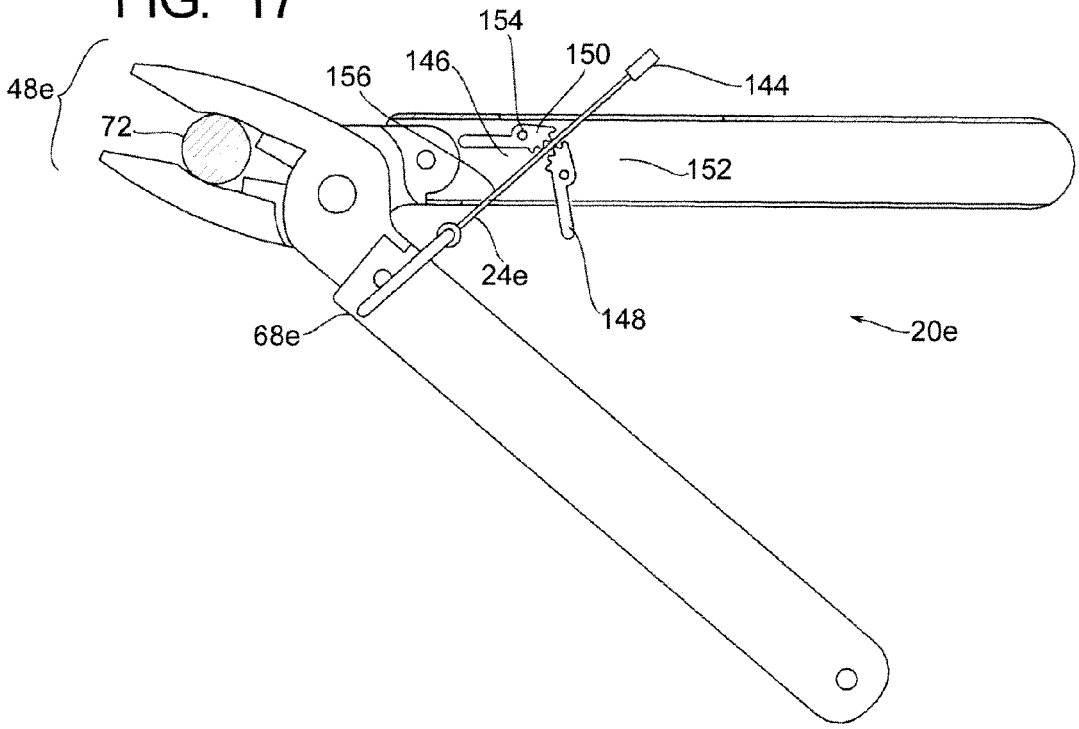
FIG. 17 is a side view, partially cutaway to show the mechanism, of one embodiment of the disclosure where the tension member is attached in the engaged position.
Figure 18:
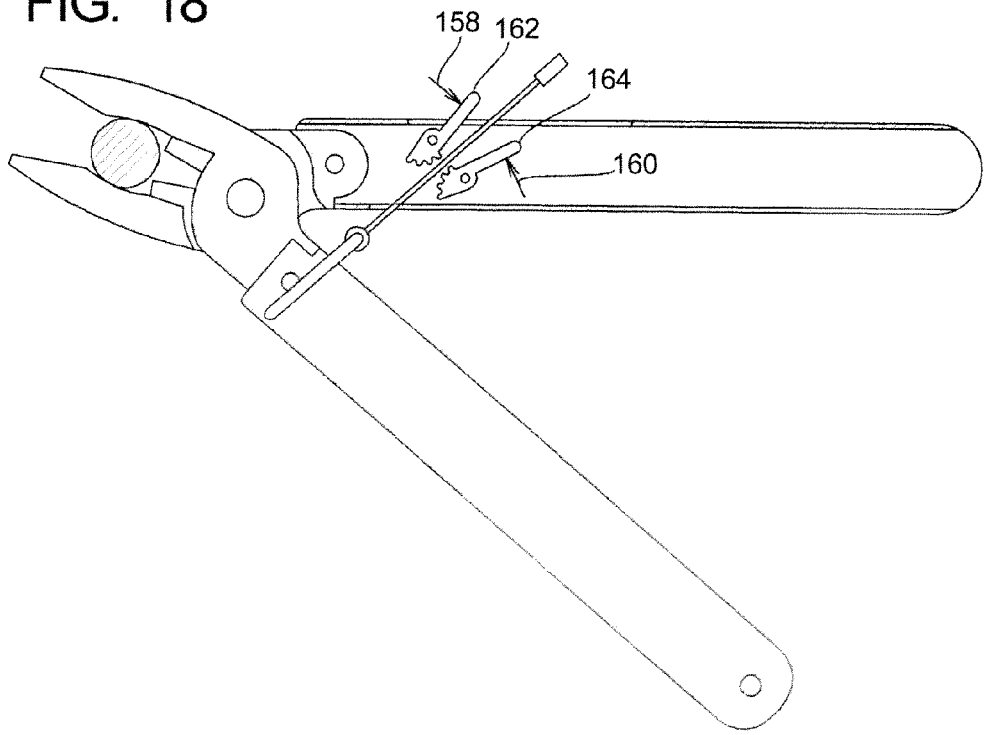
FIG. 18 is a side view, partially cutaway to show the mechanism, of one embodiment of the disclosure where the locking mechanism is disengaged from the tension member.

Referring now to FIG. 17, another embodiment is shown wherein the tension member 24*e* passes between the teeth 146 and 148 of a plurality of cam members 150 and 152. Each of these cam members has a cam member pivot 154 which allows the cam members 150 and 152 to rotate from a position as shown in FIG. 17, wherein the teeth 146 and 148 engage the outer surface 156 of the tension member 24*e* to a position as shown in FIG. 18 where force has been exerted along arrows 158 and 160 upon cam member arms 162 and 164 to disengage the teeth 146 and 148 from the outer surface 156 of the tension member 24*e*. In operation, referring back to FIG. 17, the jaw assembly 48*e* can be positioned about the material 72, and the tension member 24*e* can be adjusted by pulling on the stop member 144 in a direction away from the tension member pivot 68*e*. The locking multi-tool 20*e* can then be used in a fashion as previously discussed in other embodiments. While an embodiment is shown where the cam members 150 and 152 each have an engagement arm 162 and 164, as well as a pivot 154, it would also be a simple modification to have the cam member 150 be rotatable and the cam member 152 be fixed, or vice versa.

Figure 19:
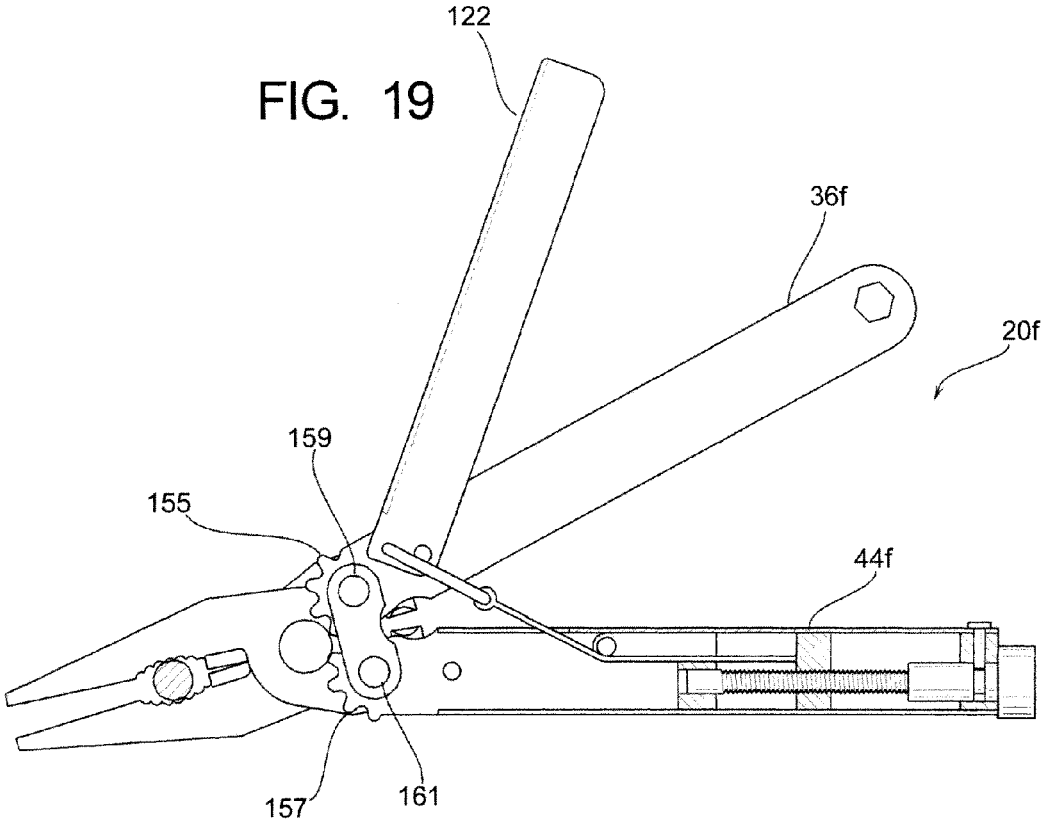
FIG. 19 is a side view, partially cutaway to show the mechanism, of one embodiment of the disclosure in combination with prior U.S. Pat. Nos. 5,809,599 and 6,003,180 in an unlocked position.
Figure 20:
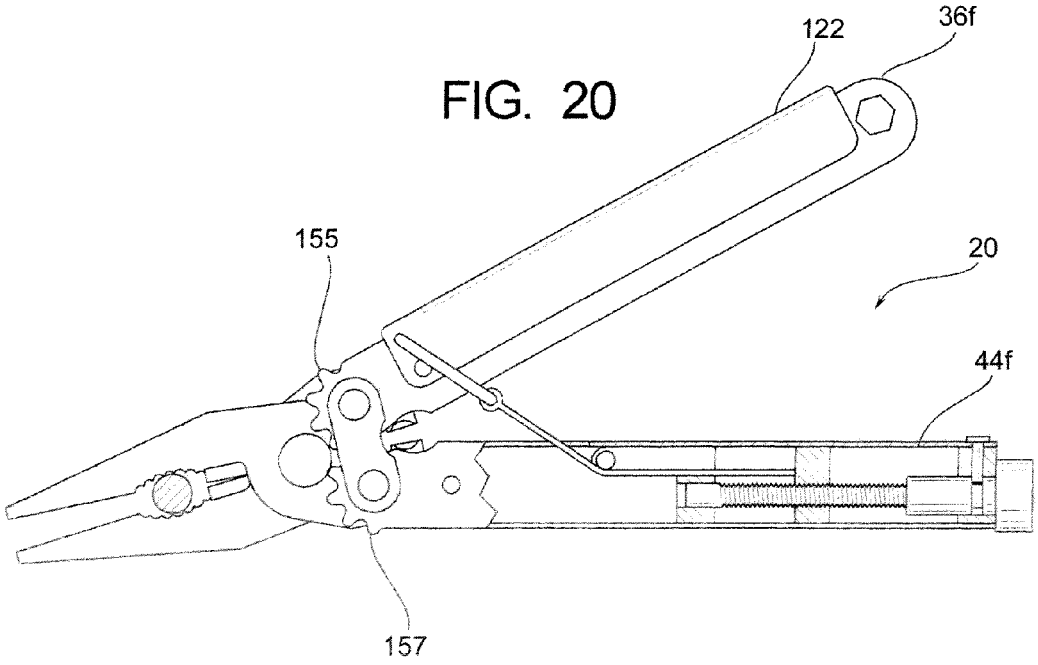
FIG. 20 is a side view, partially cutaway to show the mechanism, of one embodiment of the disclosure in combination with prior U.S. Pat. No. 5,809,599 in a locked position.
Figure 21:
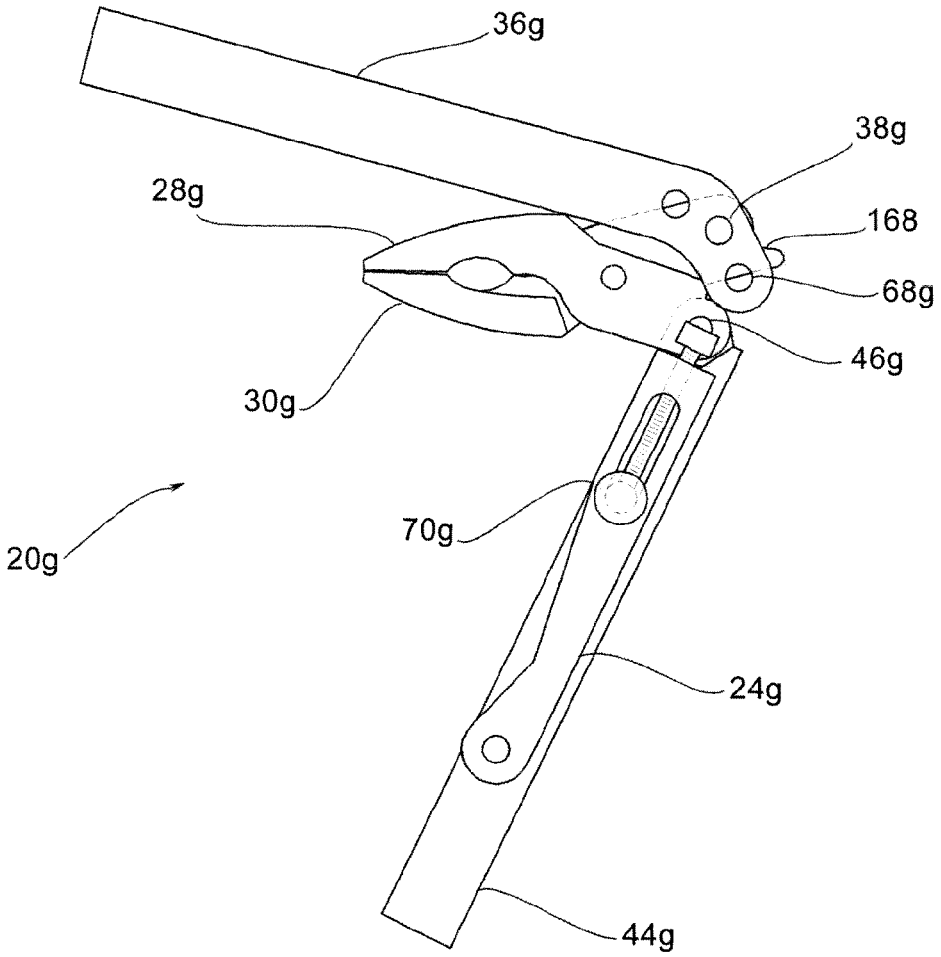
FIG. 21 shows another embodiment where the tension member is a linkage-type member.

The embodiment as shown in FIGS. 19 and 20 is a combination of the embodiment as previously disclosed in FIGS. 13 and 14 with the inventor's prior patents, U.S. Pat. Nos. 5,809,599 and 6,003,180 which are both incorporated by reference (henceforth referenced as the '599 and '180 patent). In this embodiment, the second handle 36*f* has a plurality of fingers 155 configured to interdigitate with a corresponding set of fingers 157 of the first handle 44*f*. The linkage assembly provides for a significant mechanical advantage of the multitool 20 when used either as standard pliers, or as locking pliers. While the previous embodiment utilizing an outer handle 122 is shown for reference, other embodiments utilizing a tension member can be combined with the interdigitating fingers of the '599 patent. The interdigitating fingers 155 and 157 rotate about a plurality of pivots 159 and 161 respectively of the cross bar link 163. These pivots 159 and 161 are not coaxial with the jaw pivots 38 and 46 as shown in FIG. 1. Therefore it can be appreciated that the above noted tools can operate as a regular set of pliers or a set of pliers as a multitool with a maximum open position and further operate as a clamping mechanism. The maximum open position is defined as a range of motion of the jaws which of course could be directly correlated with the rotational range of motion of the handles or in the compound of leverage embodiment discussed immediately above, a ratio of the degree of motion. At any rate, the clamping tool in one form is capable of a maximum range of motion in which it can be locked at any jaw location within this range of motion. For example, a conventional Vice-Grip allows for a small amount of range of motion of regular pliers like action but the position of the compression member must be adjusted to allow for the regular player like action throughout the full range of motion of the jaw members.

While the embodiments disclosed above show the tension member 24 used in a folding multi-tool, the tool may be produced without the folding, and without the multitool aspects. This would result in a locking tool having significant advantages over current tools using compression member technology. A hand tool is shown in FIGS. 21-27 with a linkage tension member.

Figure 23:
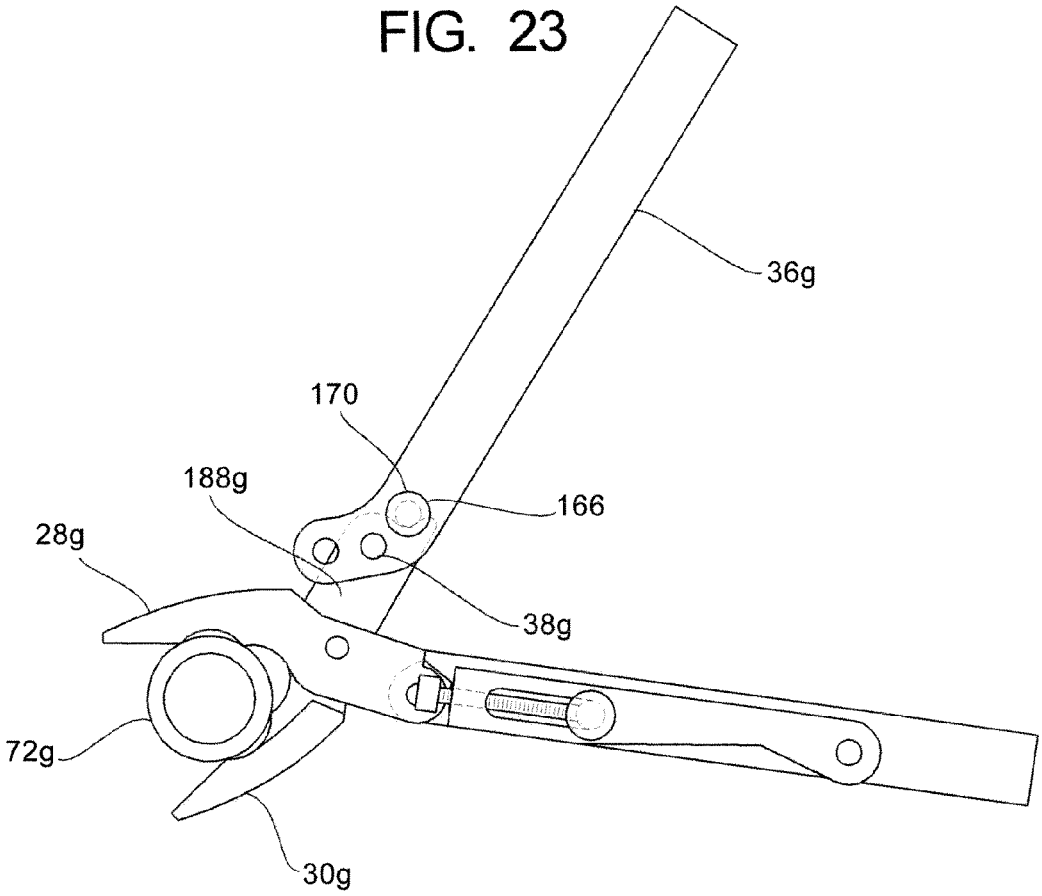
FIG. 23 shows the plier member where the jaw is grasping a material of, for example, a greater diameter where the handle members are separate from one another, and in this form the plier members operate as a regular set of pliers where the engagement pin restricts rotational movement between the second handle and the second jaw extension.
Figure 24:
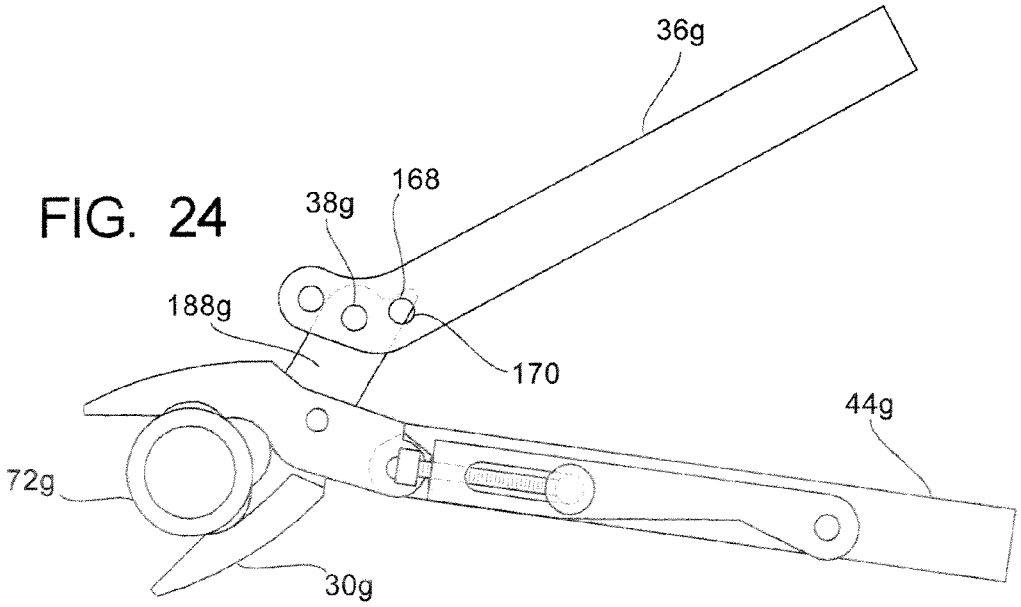
FIG. 24 shows an embodiment where the engagement pin is removed, allowing rotation of the second handle and the second jaw extension.
Figure 25:
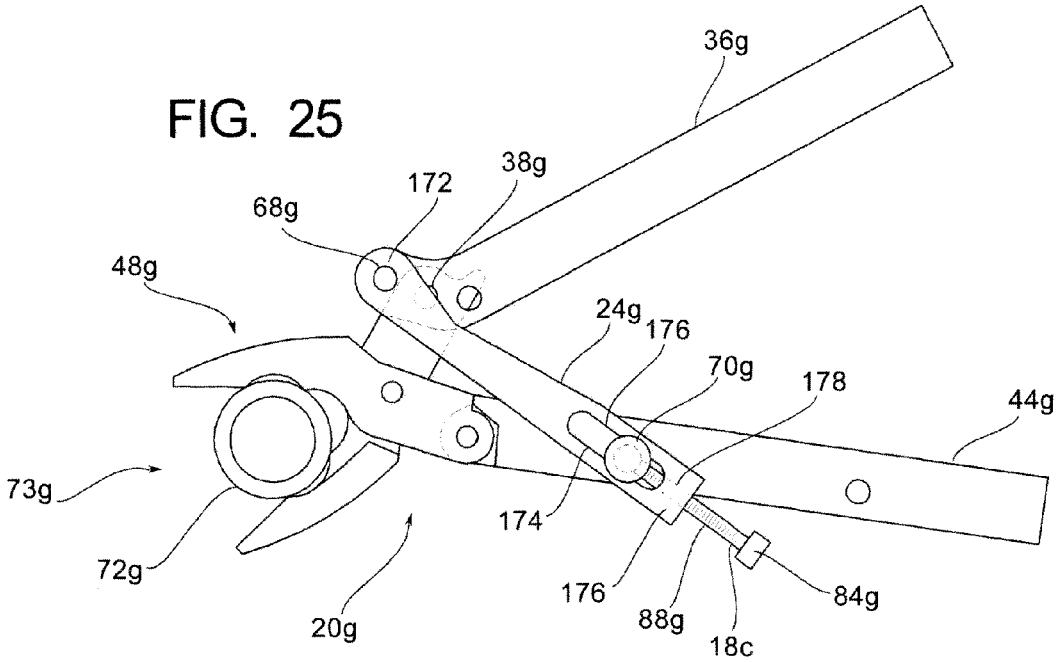
FIG. 25 shows the tension member attached to the second handle at a tension member pivot.
Figure 26:
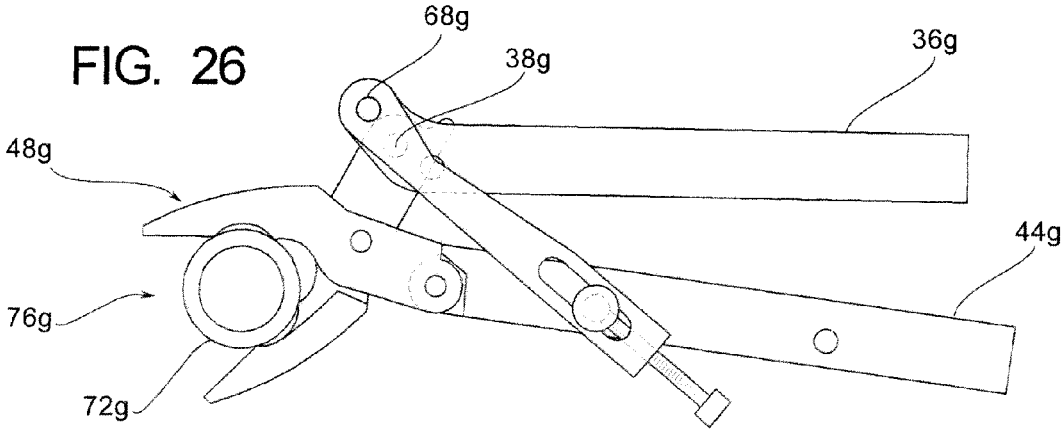
FIG. 26 shows the second handle repositioned into a locked position where the second member pivot is positioned past the center locking pivot.

The elements of this embodiment, which are similar to the elements of previous environments, will have the suffix "g" preceding the numeral designation. For example, the second handle will be labeled "36*g*." Looking now at FIG. 21, the locking tool 20*g* is shown folded substantially as far as it will go. Unlike the previous embodiments, this tool does not fold to a completely stored configuration. The second handle 36*g* is coupled to the second jaw 30*g* at a second jaw pivot 38*g*. Likewise, the first handle 44*g* is coupled to the first jaw 28*g* at a first jaw pivot 46*g*. The tool 20*g* can be used as a standard set of pliers as shown in FIG. 22-24, or alternatively as a locking set of pliers as shown in FIGS. 25-27.

Figure 22:
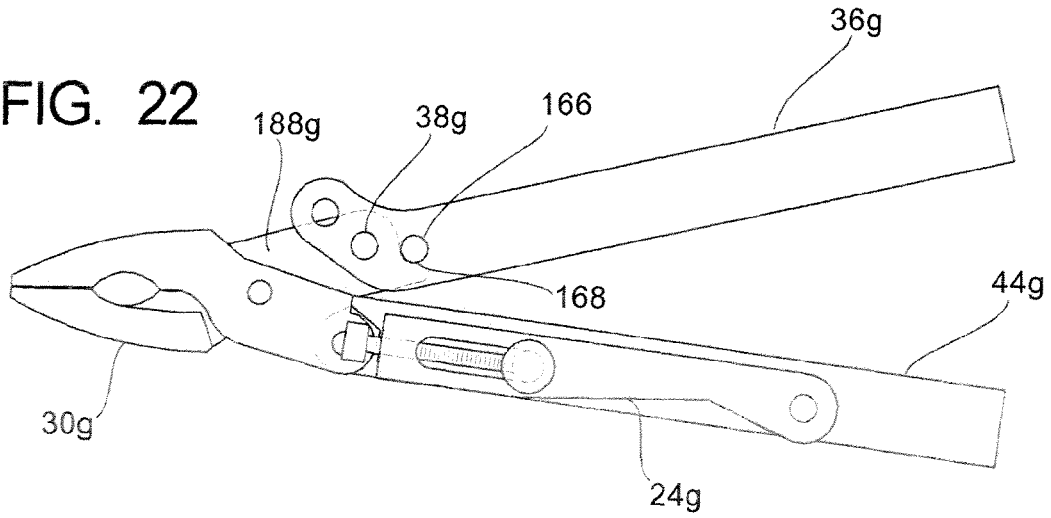
FIG. 22 shows an embodiment where the second handle is in a locked orientation with respect to the second jaw extension so the pliers will operate as a conventional set of pliers.

Looking to FIG. 22, it can be seen how the tension member 24*g* is in a stowed configuration where it is adjacent and substantially parallel to the first handle 44*g*. The second handle 36*g* has been rotated about the second jaw pivot 38*g* until the engagement pin 166 comes into contact with a surface 168 on the second jaw 30*g*. As can be seen, the tension member 24*g* is not being utilized, but as there is sufficient friction between the second handle 36G and the second jaw 30*g*, the tool 20*g* can be opened to affix the jaw assembly about a piece of material as shown in FIG. 23. The engagement pin 166 is disposed within an opening 170 in the second handle 36*g* and may be retained by the second handle 36*g* by way of threads wherein the engagement pin 166 is a threaded bolt or screw or may be a similar connective apparatus. Likewise, the surface 168 (see FIG. 24) is configured to allow the second handle 36*g* to rotate about the second jaw pivot 38*g* in relation to the second jaw 30*g*. The surface 168 could also be formed such that the second handle 36*g* is not allowed to rotate about the second jaw pivot 38*g*. For example, the surface 168 may be an opening which allows the engagement pin 166 to be disposed therein, and may include thread to positively engage the engagement pin 166.

Of course, a plurality of types of attachment mechanisms can be utilized to attach the second jaw extension 188*g* to the second handle 36*g*. A plurality of types of pins, levers, or other conceived attachment-type mechanisms can be utilized to temporarily attach the second handle 36*g* to the second jaw member 30G to form a solid plier unit structure.

Figure 27:
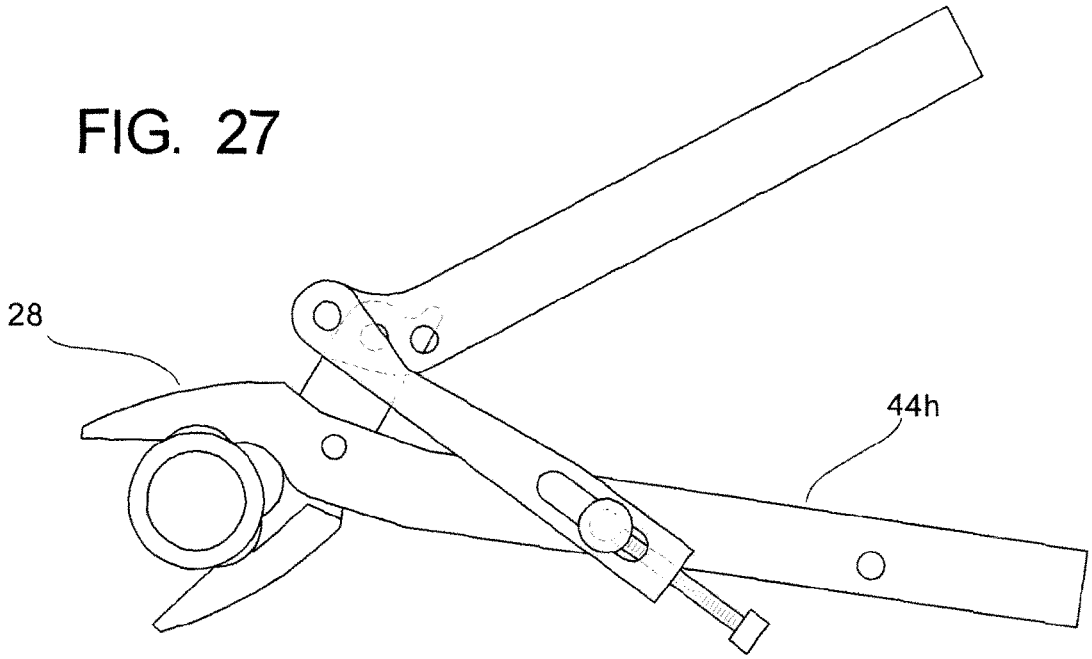
FIG. 27 shows a similar embodiment as to the previous embodiment except the first handle is shown in a fixed unitary structure so as to not necessarily be a folding plier assembly.

In the environment shown in FIGS. 21-27, it would be conceivable that the first jaw 28*g* in the first handle 44*h* may be formed as a unitary structure. This embodiment is shown in FIG. 27.

Now referring to FIG. 24, it can be seen how the engagement pin 166 has been removed, allowing the first handle 36*g* to rotate about the jaw pivot 38*g* such that the opening 170 has rotated past the engagement surface 168 of the second jaw 30*g*. It can be appreciated that in this arrangement, a user would not be able to impart substantial force upon the piece of material 72*g* as further pressure upon the handles would simply rotate the second handle 36*g* to a point at which it contacts the first handle 44*g*.

Now referring to FIG. 25, the tension member 24*g* has been rotated about the rear tension member pivot 70*g*. The engagement pin 166 has been removed from the opening 170 and has been positioned within the opening 172 of the second handle 36*g*. Of course the same pin 166 could be used, or another pen of similar design. In this configuration, the tool 20*g* can be operated as a locking set of pliers. Once again a dead point line is an imaginary line drawn between the center of the rear tension member pivot 70*g* and the center of the second jaw pivot 38*g*. In the first position 73*g*, shown in FIG. 25, the jaw assembly 48*g* of tool 20*g* is positioned about a piece of material 72*g*, such as a pipe. At this point the thumbscrew 84*g* is rotated and engages the threaded rod 88*g* against the pivot 70*g*. This effects a change in the distance between the center of the front tension member pivot (the second tension attachment location) 68*g* and the rear tension member pivot 70*g* (defining the first tension attachment location). A slot 174 formed of a plurality of surfaces 176 within the tension member 24*g* allows the tension member 24*g* to reposition in reference to rear tension member pivot 70*g*. The tension member 24*g* includes an opening 176 configured to accept the threaded rod 88*g*. Within the opening 176 are threads 178 which are configured to engage the threads 180 on the threaded rod 88*g*. Thus as the thumbscrew 84*g* is rotated, the threaded rod 88*g* is repositioned longitudinally, which limits the amount of travel of the pivot 70*g* within the slot 174.

In operation, as shown in FIG. 25, the jaw assembly 48*g* is positioned about a piece of material 72*g* and the thumbscrew 84*g* is tensioned, adjusting the distance between the front tension member pivot 68*g* and the rear tension member pivot 70*g* until the jaw assembly 48*g* is snubbed against the material 72*g*. In this orientation, the front tension member pivot 68*g* is forward of the dead point axis as previously described. Force is then exerted upon the second handle 36*g* toward the first handle 44*g*. This functions to operate the second handle 36*g* as a first-degree lever pivoting about the second jaw pivot 38*g* and pulling upon the tension member 24*g* against the first handle 44*g*. This will exert substantial force upon the material 72*g* by the jaw assembly 48*g*, reaching a highest point of compression force at the second position wherein the front tension member pivot 68*g* is in line with the dead point axis. Continued force upon the second handle 36*g* toward the first handle 44*g* will force the front tension member pivot 68*g* to a locked orientation.

Figure 28:
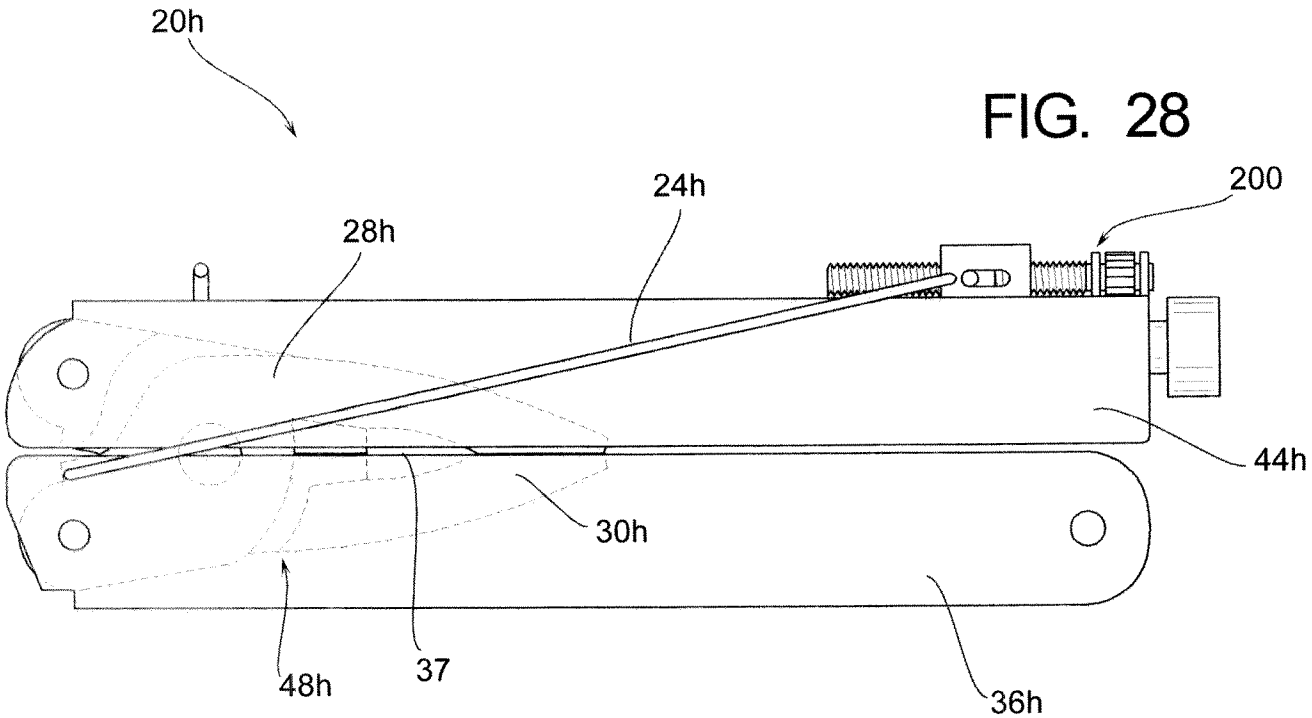
FIG. 28 shows another embodiment of a folding multi-tool assembly where the folding multi-tool is in a closed orientation.

Now referring to FIG. 28, there is shown yet another embodiment of a pliers unit being a tension member locking pliers. In this form, the tension member locking tool 20*h* is shown in a stored orientation where the first and second jaw members 28*h* and 30*h* are stored within a chamber region 37 as defined by interior surfaces of the first and second handles 44*h* and 36*h*.

Figure 30:
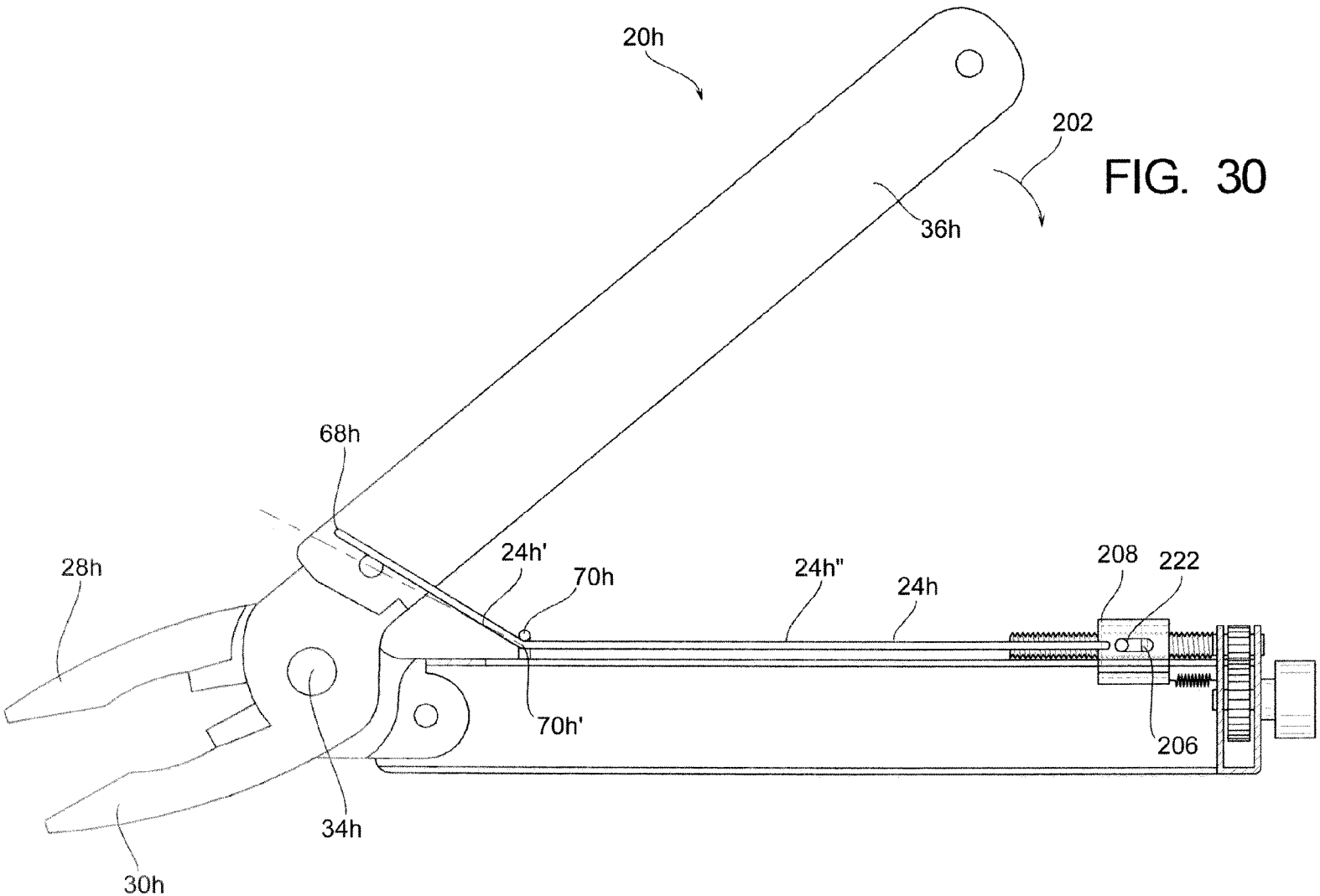
FIG. 30 shows the folding locking multi tool assembly where the tension member is positioned in the locked region with respect to the dead point axis.
Figure 31:
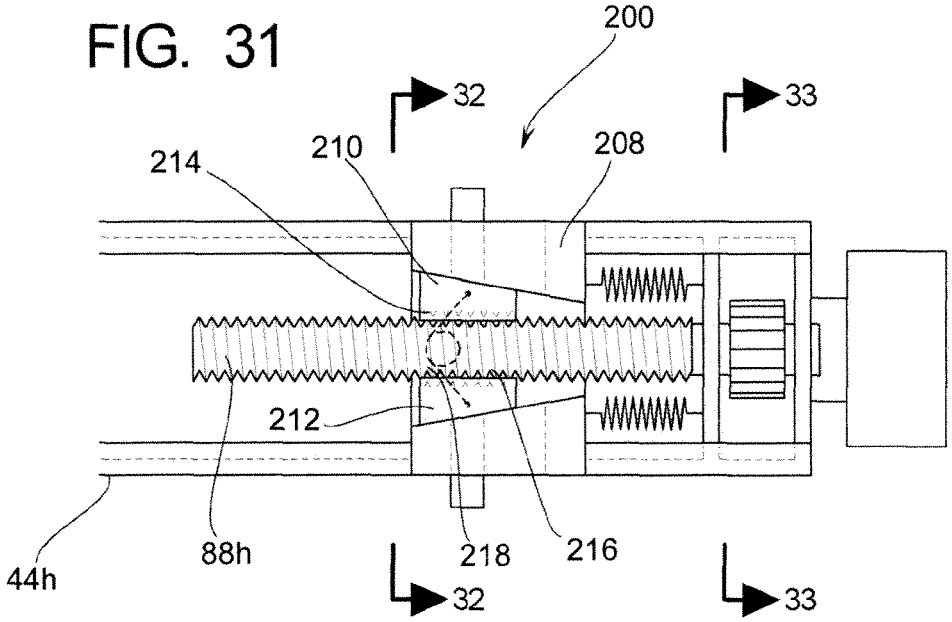
FIG. 31 is taken along line 31-31 of FIG. 29 showing a top view of the tension quick-release assembly.

One feature of particular interest of this embodiment is best shown in FIG. 31 where the tension quick release assembly 200 is shown in a top view. In general, the tension quick release assembly provides one embodiment illustrating the principle of allowing the tool 20*h* to be utilized as a conventional set of pliers, as shown in FIG. 30 where as the second handle 36*h* is repositioned by way of the directional vector 202, the second attachment location 68*h* will likewise reposition about the jaw assembly pivot 34*h*, and this effectively modifies the distance of the tension member 24*h*. In one form, the tension member 24*h* pivots about the rear tension member pivot 70*h* wherein the effective first connection location is approximately at the location indicated at 70*h*'. As noted above, the effective portion 24*h*' is the effective portion of the tension member providing the tension vector between the first and second tension attachment location 71*h* and 68*h*.

Figure 32:
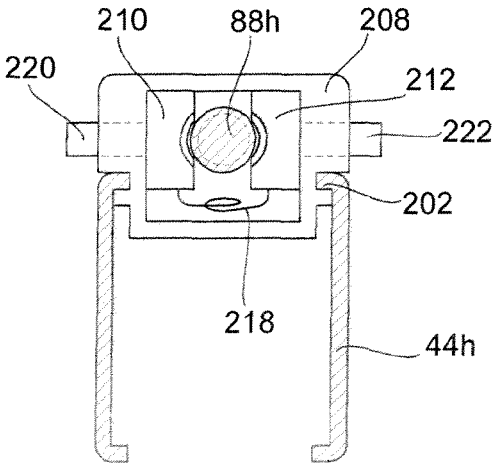
FIG. 32 is taken along line 32-32 of FIG. 31 showing a cross-sectional view of the handle member looking upon the tension quick-release assembly.
Figure 34:
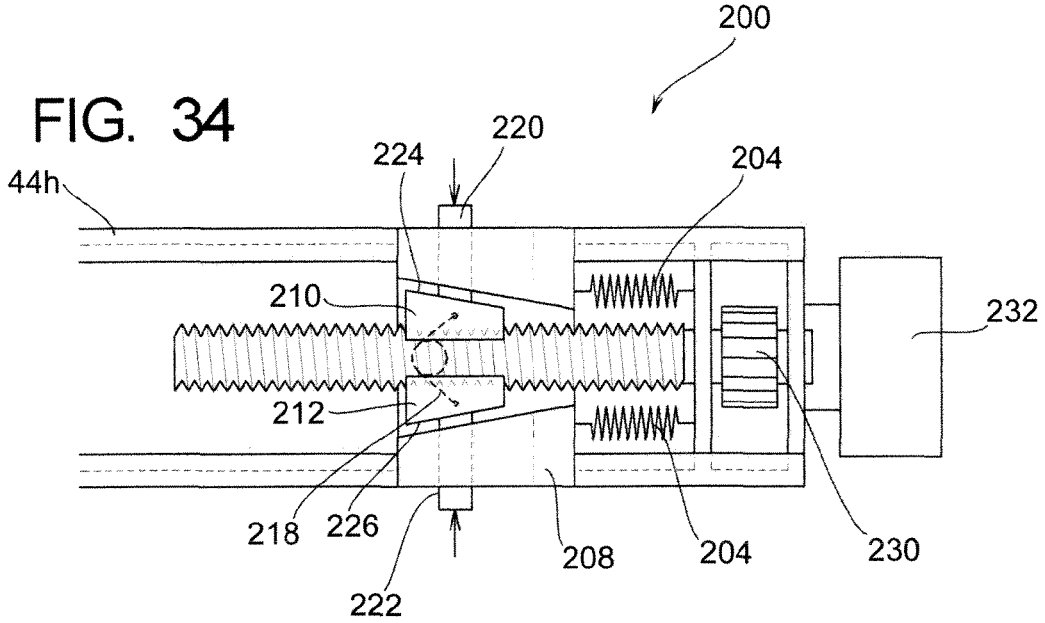
FIG. 34 shows one form of operation of the tension quick-release assembly wherein the engagement members are biased inwardly to engage the threaded portion of the threaded rod.
Figure 35:
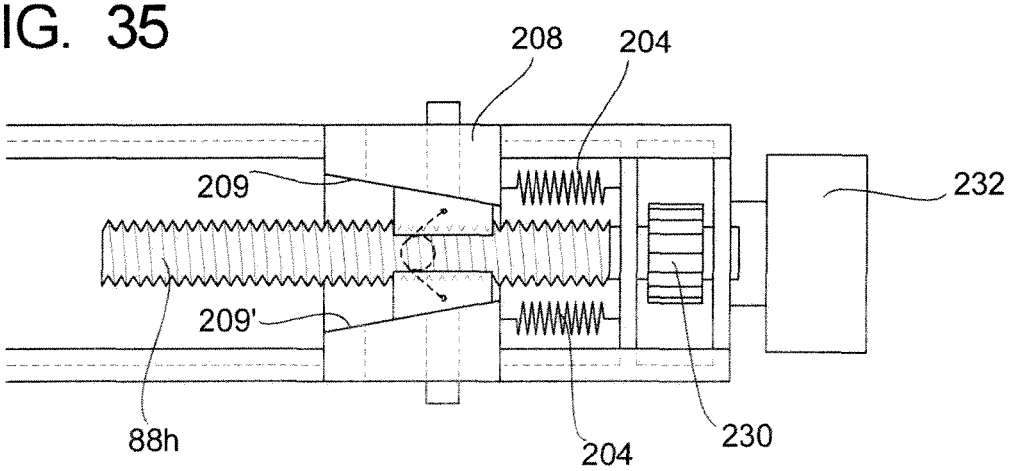
FIG. 35 shows the engagement members engaged in the threaded rod whereby the engagement members are biased laterally inwardly by way of a pillow block having slanted surfaces in one form.

Therefore, still referring to FIG. 30, it should be noted that when the pliers are utilized as regular types of pliers simply pivoting about the jaw pivot 34*h*, the tension member must change its length with a fixed pivot point 78*h*. Therefore, referring to FIG. 31, it can be appreciated that the first and second engagement members 210 and 212 each have a longitudinally laterally inward threaded portion 214 and 216 which are of the thread pitch and depth to engage the threaded rod 88*h*. However, the biasing member 218, which in one form can for example be a torsional spring, separates the first and second engagement members 210 and 212 so as to be disengaged from the threaded rod in a normal plier-like operation. Referring now to FIG. 34, it can be appreciated that the engagement extensions 220 and 222, which are connected to the first and second engaging members 210 and 216 so as to engage the threaded rod whereas the pillow block 208 is provided with the slanted interior surface 209 and 210 so as to engage the correlating exterior laterally slanted surfaces 224 and 226 of the first and second engagement members as shown in FIG. 35. In other words, once the first and second engagement members are engaged to the threaded rod 88*h*, the rod can be rotated longitudinally so as to bias the pillow block longitudinally rearwardly, and the nature of the surfaces are such that the pillow block biases the engagement members toward the threaded rod. Therefore, referring now to FIG. 29, it can be appreciated that in general if the first and second jaws 28*h* and 30*h* are (for example) positioned around a material (not shown), the first and second engagement extensions 220 and 222 as shown in FIG. 34 can be depressed, and thereafter the threaded rod 88 can be rotated to a proper tension so the second jaw base 188*h* has at least some pretension applied thereto when the locking member (second handle 36*h*) is in the unlocked orientation. Therefore, when a proper amount of tension is prescribed to any particular distance between the first and second jaw members 28*h* and 30*h*, the locking lever 36*h* can be repositioned from the orientation as shown in FIG. 32 to the locked orientation otherwise referred to as the third position with respect to the embodiments herein above.

It can therefore be generally appreciated that the tension quick release assembly 200 as shown in FIGS. 31, 34 and 35 provides a convenient system for selectively locking the tension member 24*h* into a fixed position. Now referring back to FIG. 28, it can be appreciated that the multitool can be folded to a folded state where the tension member 24*h* in one form can extend laterally around the jaw assembly 48*h*. Therefore, it can further be appreciated that the tension quick release assembly 200 not only provides usage of the pliers as regular pliers, but further allows the unit to be folded without the need of loosening or otherwise repositioning the pillow block by rotating the threaded rod to allow enough slack within the tension member 24*h*.

Figure 29:
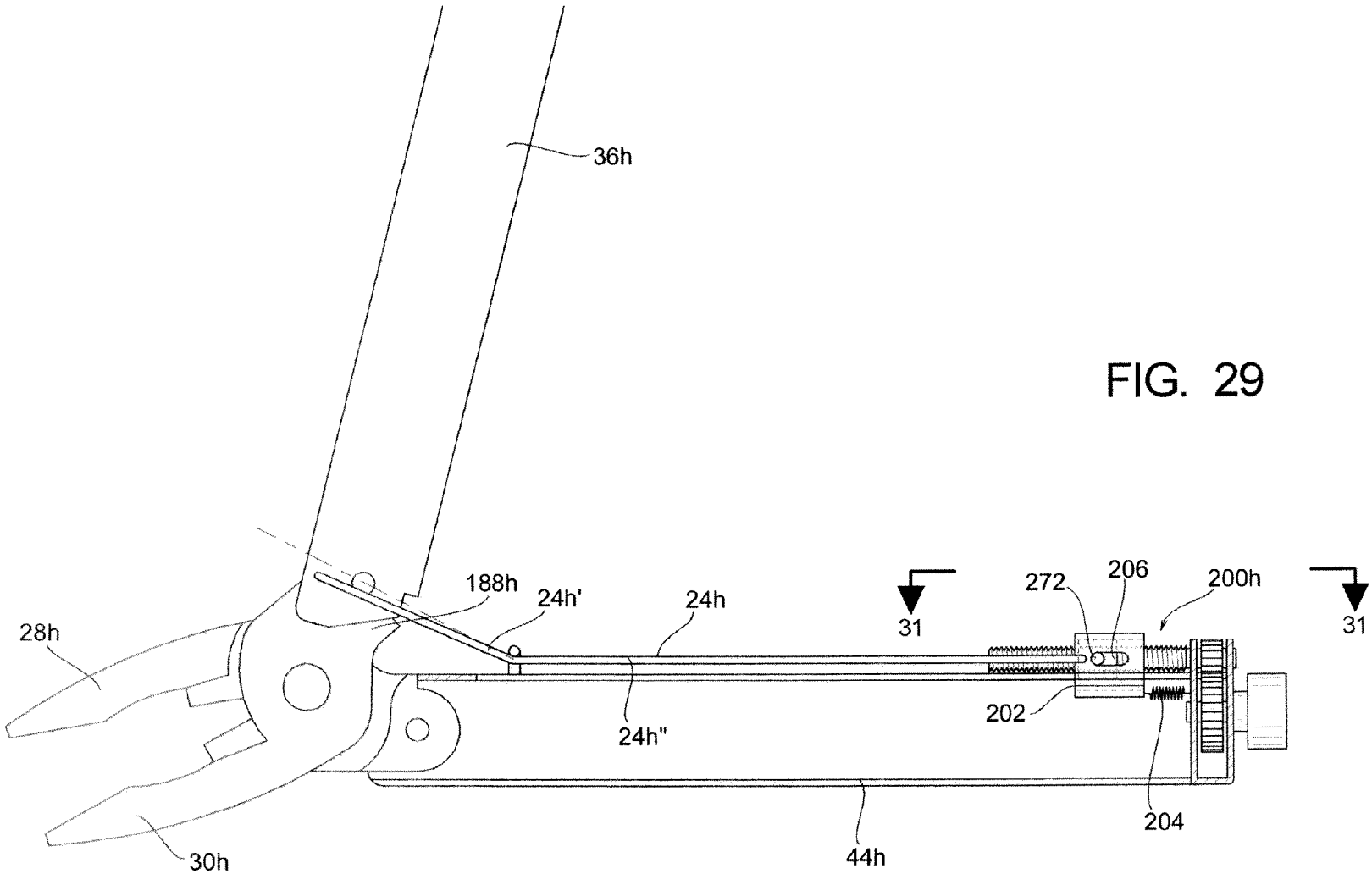
FIG. 29 shows the additional embodiment in an operational orientation where the second handle is in a cocked orientation, having the center locking pivot positioned in the unlocked region with respect to the dead point axis.

With the general description in place of the embodiment shown in FIGS. 28-33, there will now be a more detailed description of all of the components and various entities thereof. As shown in FIG. 34 and as generally introduced above, the tension quick release assembly 200 comprises a pillow block 208 which is configured to be movably attached to the first handle 44*h*. In one form the pivot block could be, for example, slidably attached by way of a slot-like extension 202 as shown in FIG. 29. Of course it should be noted that the assembly 200 need not necessarily be in the transverse inward portion of the handle 44*h*, but could for example be slightly embedded therein. Of course, the position of the tension quick release assembly 200 could be in a variety of positions and orientations depending upon the number of tools positioned within the handle 44*h* and other factors.

As is further shown in FIG. 34, springs 204 can be provided which continuously bias the pillow block 208 in a longitudinally rearward direction. As the tool is in general operation with the jaw members 28*h* and 30*h* (see FIGS. 29 and 30) repositioning in various open and closed orientations, the overall length of the effective tension member portion 24*h*' is continuously adjusted, which in turn adjusts the other portion of the tension member 24*h*", and therefore, it is convenient to have the pillow block automatically repositioned longitudinally rearwardly by way of the spring or springs or other biasing members 204. In one form the springs can be tension springs, but of course a biasing-type system could be employed. A biasing system such as a spring provides a matter of convenience so there is no undesirable slack within the tension member 24*h* as the pliers either being folded or unfolded or being used as a regular set of pliers.

It can further be noted in FIGS. 34 and 35 that the pillow block has the sloped surfaces 209 and 209' which in one form slope from a narrow portion in the longitudinal rearward region to a more open portion in a longitudinally forward region. Of course the slope as introduced above is configured to engage the engagement members 210 and 212 so as to bias them laterally inwardly when the tool is used as a locking mechanism.

Figure 33:
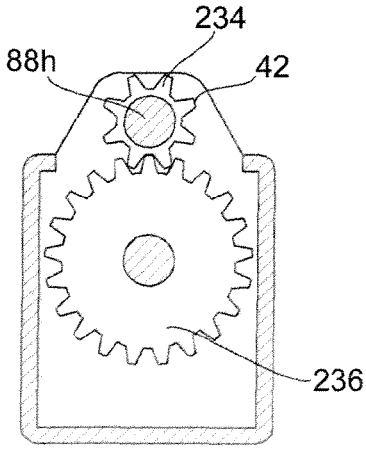
FIG. 33 is taken along line 33-33 of FIG. 31 showing a cross-sectional view of the handle illustrating one form of a possible gear reduction mechanism.

It should further be noted as shown in FIGS. 28 and 29 that there are surfaces 206 which define lateral openings for the first and second engagement extensions 220 and 222 to extend therethrough. The engagement extensions 220 and 222 as shown in FIG. 34 are attached to the first and second engagement members 210 and 212 respectively. The engagement extensions in one form can allow for a general positioning of the engagement members 210 and 212 so they remain intact between the surfaces 209 and 209'. In one form the biasing members/spring 218 are provided to separate the engagement members 210 and 212 (see FIG. 31) so they remain disengaged from the threaded rod 88*h*. This allows for the pillow block 208 to freely rotate up and down along the first handle 44*h*. Therefore it can be appreciated that as shown in FIG. 34 the engagement extensions 220 and 222 can be repositioned laterally inwardly and of course engagement extensions could be of a variety of sorts, not necessarily positioned in a laterally extending manner outside the handle, but could for example be of an upper transverse portion of the pillow block or in a variety of positions and orientations to operate in a manner to basically have the engage remembers 210 and 212 engage the threaded rod. As shown in FIG. 35, the threaded rod can then be quickly rotated by way of the rotation portion 230 or by way of rotating the torquing knob 232 as shown in FIG. 33. The torquing knob in one form is attached to a gear member having a gear ratio with respect to the threaded rod gear 234. The gear member 236 can have different prescribed ratios to provide additional torque. In one form the rotation portion 230 may be sufficient to rotate the threaded rod 88*h*. However, if mechanical advantage is required, the torquing knob 232 can be employed. It should further be noted that referring to FIG. 34, the engagement extensions 220 and 222 could also be simultaneously repositioned longitudinally rearwardly and then clamped upon the threaded rod so as to give the tension member a slight bit of force applied thereto to bring the surfaces 224 and 226 in closer engagement to the surfaces 209 and 209'. Therefore, it can be appreciated that the opening 206 as shown in FIG. 29 should have some play in a longitudinal direction to allow repositioning of the engagement extensions 220 and 222 therein. It should be noted that in FIG. 30, the engagement extension 220 is actually not in a locked position, which is apparent because it is in the longitudinal forward region of the surface defining the opening 206 of the pillow block 208. Therefore, the arrangement FIG. 30 shows the tension locking pliers 20*h* in a normal pliers mode. Although it can be generally appreciated that if, for example, the extension members 222 and 220 (not shown) in FIG. 29 were pressed rearwardly and the threaded rod were rotated to ply some tension to the tension member 24*h*, thereafter the locking lever/member 36*h* could be repositioned in a manner as shown in FIG. 32 to lock any material or tool pieces positioned between the jaw members 28*h* and 30*h*.

Of course as shown above, the locking member in this form is the second handle, but a locking member could be other types of mechanisms such as the locking lever embodiment as shown in FIG. 13 above. Of course, other concepts of providing a locking mechanism could be employed, such as pulling the second tension attachment location over a cam surface pass a high point which would operate as the center locking pivot as disclosed as an example in FIG. 51 discussed herein.

Figure 36:
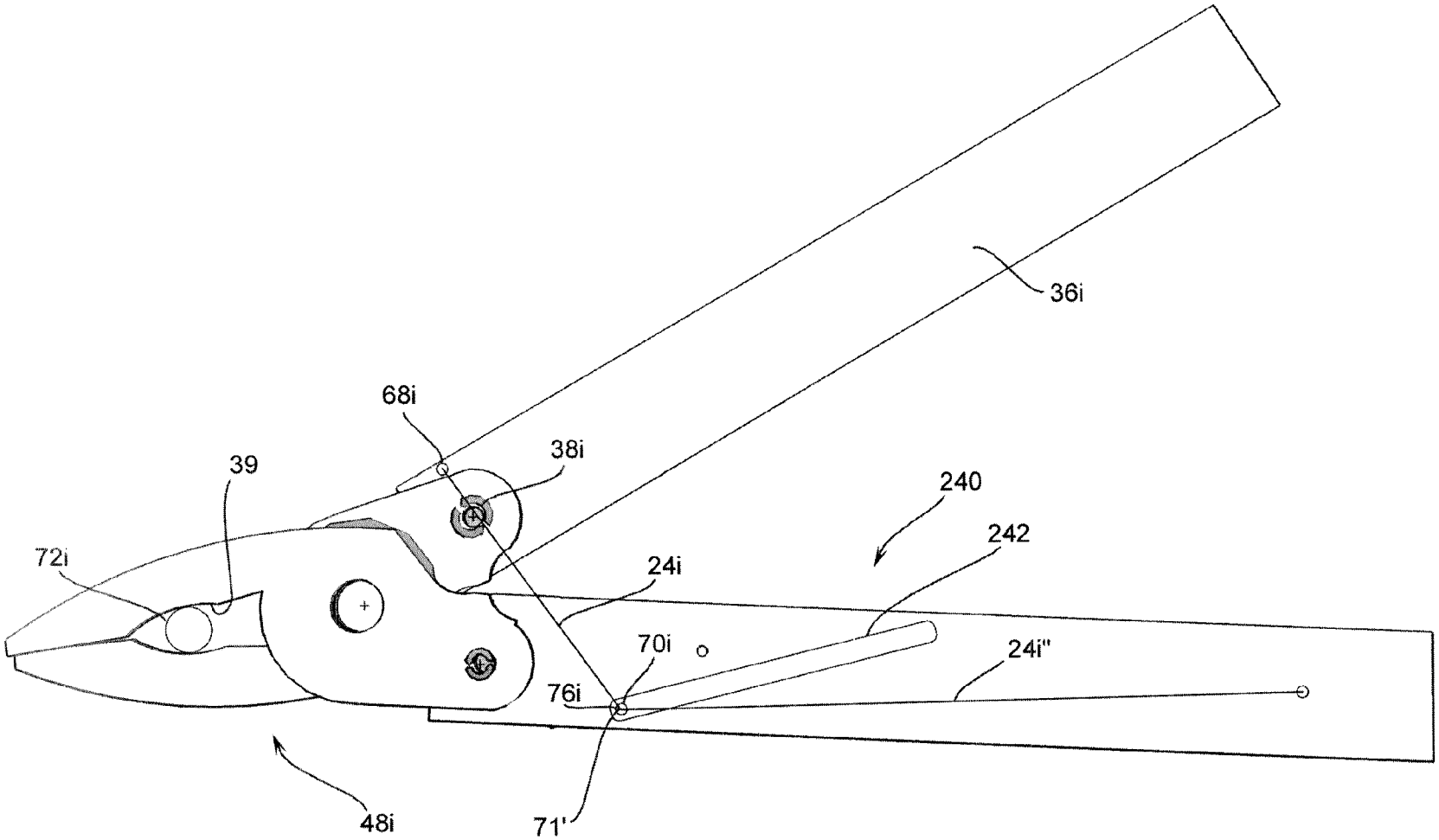
FIG. 36 shows another embodiment where the tension member has a movable pin where in one form the slanted track of the tension member allows for a substantially constant length tension member attached between the two handles.
Figure 37:
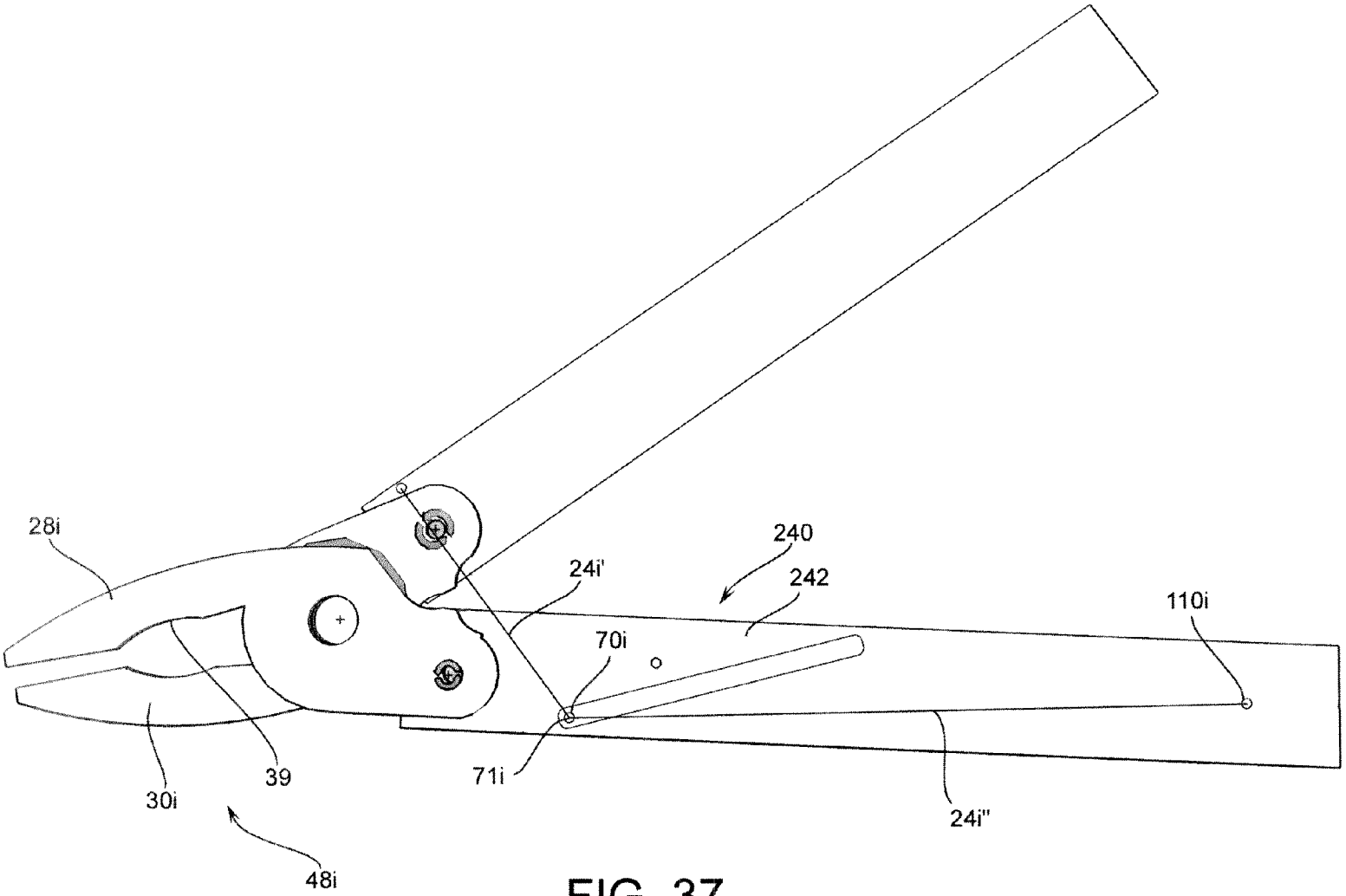
FIG. 37 shows the plier assembly with the jaw member in a slightly more open orientation.
Figure 38:
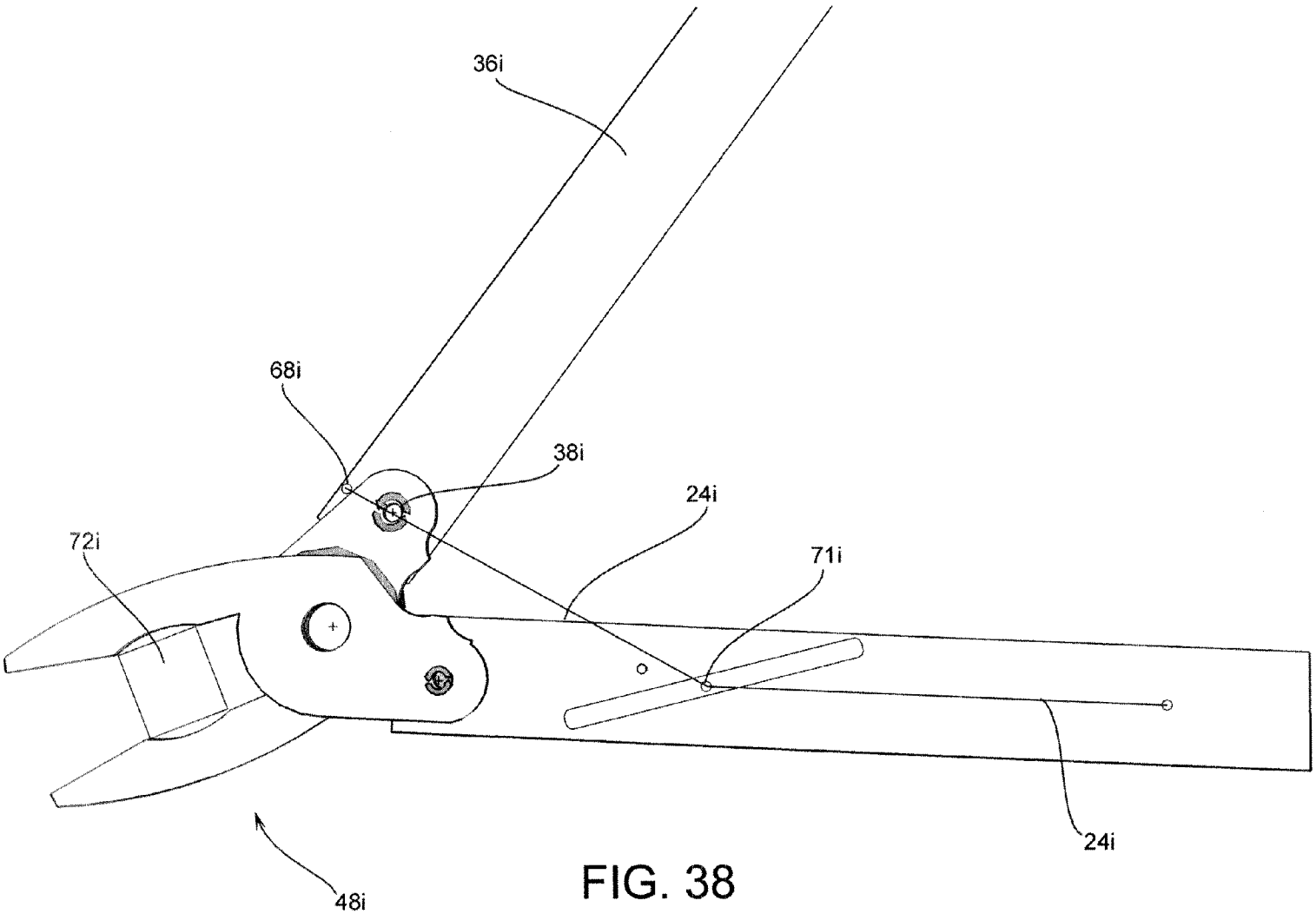
FIG. 38 shows another embodiment where the jaw member is in a more open orientation with respect to FIG. 37.
Figure 39:
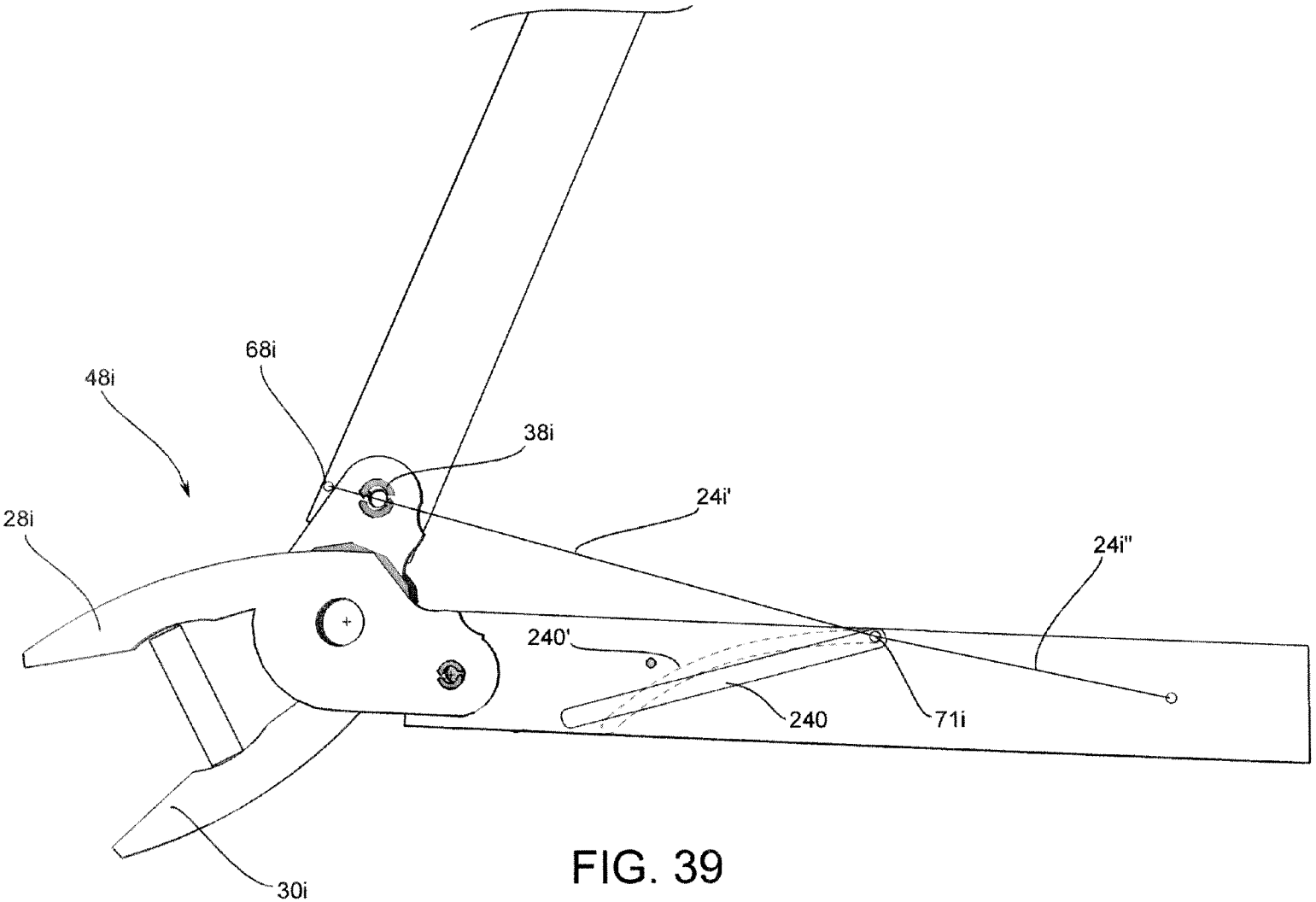
FIG. 39 shows a jaw member in a more open orientation illustrating the repositioning of a first connection location of the tension member to an upward and longitudinally rearward position.

Now referring to FIGS. 36-39, there is shown yet another embodiment which provides a concept of having the overall length of the tension member substantially constant, whereas the location of the first connection location repositions to adjust the correctional tension vector component of the effective portion 24*i*' as well as adjusting the length of this effective tension portion, giving the various orientations of the jaw assembly 48*i*. In other words, the progressive FIGS. 36-39 illustrate the concept that the locking vector, otherwise referred to as the relationship between the second attachment location or second tension location 68*i* with respect to the center locking pivot 38*i*, changes as the jaws reposition from a closed orientation as shown in FIG. 36 to an open orientation as shown in FIG. 39. In other words, to simplify the explanation of this matter, the position of the second handle 36*i* is constant with respect to the second jaw 30*i* throughout FIGS. 36-39. In fact the position of the second handle 36*i* and the second jaw 30*i* is such that the position of the center locking pivot 30*i* and the second tension location 68*i* is substantially near the dead point center at its maximum stored energy location of the tension member or otherwise right along the dead point axis, which is defined above but is generally defined as the axis defined between the center locking pivot 38*i* and the first tension attachment location 71*i*. Therefore, it can be appreciated that the position of the effective tension location 24', which in this case is substantially along the dead point axis, repositions greatly from a closed plier location, as shown in 36, to a more open plier location as shown in FIG. 39. This concept is important to convey because in general the second tension location 68*i*, as shown in FIG. 9, should rotate past the dead point center axis, which basically means rotate clockwise just past the center locking pivot 38*i* so as to lock the jaw assembly 48*i*. If the second tension location 68*i* rotates too far in a clockwise direction past the center locking pivot 30*i*, there would be an excessive loss of tension, and the effective portion of the tension member 24*i*' would allowing the first and second jaw members 28*i* and 30*i* to separate from one another excessively. In general, having a rotation of anywhere from 0.5° to 50° functions as a broader range. Further, the tension member can be elastic to provide a greater range of motion past the dead point center axis when locking the tool assembly.

As noted above, the length of the tension member has generally been adjusted to accommodate the different desired jaw openings depending on the size of the material to be clamped. However, depending on the configuration of the pliers and the size of the material to be clamped, the orientation of the three key elements (the first tension attachment location 71*i*, the second tension attachment location 68*i*, and the center locking pivot 38*i*) must be properly orientated so the plier unit can indeed lock and further so the locking lever does not over-rotate and cause excessive lack of tension in the tension member 24*i*. Therefore, with the foregoing background description in place, the embodiment as shown in FIGS. 36-39 provides one possible embodiment which can have a constant length tension member which adjusts the effective portion of the tension member 24*i*' as well as the position of the first tension location 70*i*, and accomplishes this with a constant length of the overall tension member 24*i*. A description of the various configurations of the tool in FIGS. 36-39 will be helpful to the reader to explain the above-noted concept.

As shown in FIG. 36, it can be appreciated that the first and second jaw members 28*i* and 30*i* are positioned in close engagement to other, which could be utilized to clamp a very thin material interposed therebetween, or perhaps a material within the center region 39. At any rate, once the jaw assembly 48*i* is orientated into a substantially proper location thereafter, r the rear tension member pivot 70*i* is positioned along the slot 240, which is one form of a first tension pivot adjustment system. In general, if the system comprises a pin 70*i*, then the first tension attachment location 71*i* would for example be slightly below and to the left of the pin 70*i*. Therefore, it can be appreciated that the overall length of the tension member is substantially fixed, and for example the portion of the tension member defined as the effective portion 44*i*' could be one and half inches, and the remainder longitudinally rearward portion 24*i*" could be 3 inches and 5/16 of an inch all the way back to the attachment point 110*i*. Now referring to FIG. 37, it can be appreciated that the jaw assembly 48*i* is positioned slightly further apart, for example to accommodate a material which is of a greater cross-sectional size. In this form, the first tension point adjustment system 240 would reposition the pin 70*i* upwardly and rearwardly along the surface defining the slot 242. Therefore, it can be appreciated that the effective portion 24*i*' of the tension member has necessarily increased, and for this example is now at 1 9/16 an inch, whereas the longitudinally rearward portion 24*i*" of the tension member is now less at 3 3/16 of an inch, but the sum of these two values is substantially the same as the previous sum of the values of the lengths 24*i*' and 24*i*" as shown in FIG. 36. Again referring to FIG. 38 it can be appreciated that a material of a greater size indicated at 72*i* is positioned between the jaw assembly 48*i*, and again the second tension member attachment location 68*i* is at the proper relative location to be substantially positioned along the dead point axis with respect to the center locking pivot 30*i*. It can therefore further be appreciated that the proper locking position of the first tension location 71*i* is now further longitudinally rearward, and in this case laterally inward. Present analysis for this configuration had the portion of the tension member 24*i*' to be approximately 2¼ of an inch, and the rearward portion 24*i*" to be at 2 and 9/16th of an inch. Finally, FIG. 39 shows the jaw assembly in a widened position, so the portion 24*i*" is approximately 3 and ¼ of an inch and the rearward portion of the tension member 24*i*" is at 1 and ⅝ of an inch. The difference between the sums of the lengths of the tension members on either side of the first connection location 71*i* is substantially constant and it can be appreciated that having the path of travel of the first tension location 71*i* can be such to adjust the length of the effective portion of the tension member 24*i*' as well as the position of the first connection location so as to provide a proper locking orientation of the locking member 36*i*.

Therefore, it can be appreciated that the constant lengths are substantially similar to the sum of the two portions of the tension member. In one form, the slot 240 or otherwise the path of travel can be non-linear, and for example, in other forms as shown in FIG. 39 could have an arc (such as a laterally outward arc) from the longitudinally rearward portion to the longitudinally forward portion to provide an arc-like slot 240' which provides a desirable profile and repositioning of the first tension attachment location 71*i* to maintain a constant length of the tension member throughout the various orientations of the jaw assembly 48*i* while having the handles in a locked position.

Figure 41:
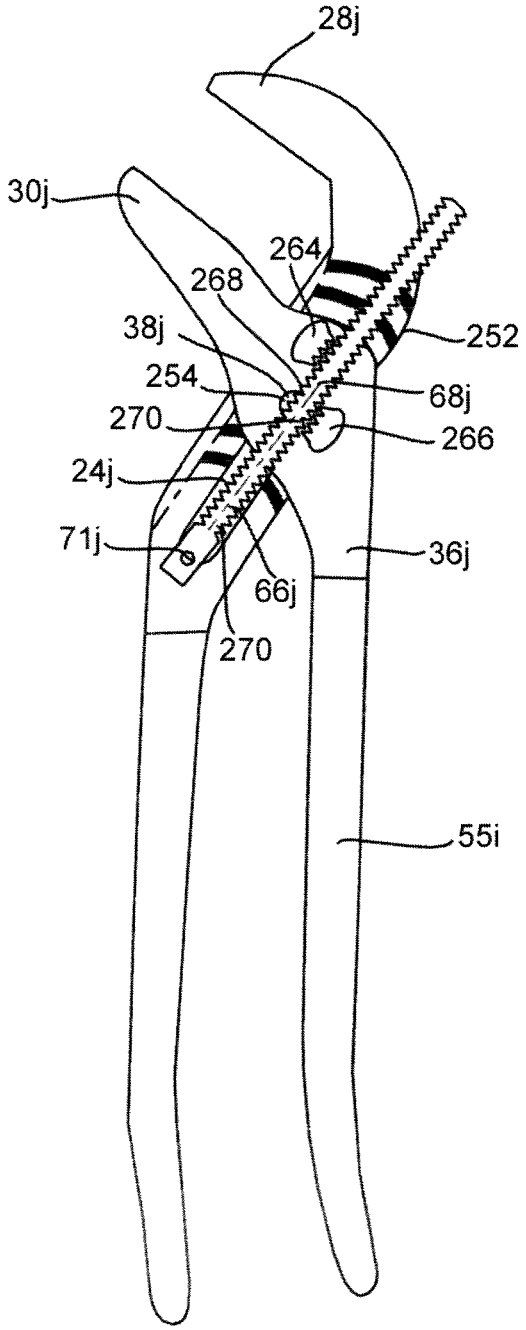
FIG. 41 shows the channel locks in a closed orientation where the tension member is past the rotation point of the second handle.

There will now be a description of yet another embodiment as shown in FIGS. 40 and 41. In general, the tension locking pliers 20*j* in this form comprise a first plier unit 53*j* and a second plier unit 55*j*. Of course as described above, the plier unit is generally defined as the entire member from the jaw to the handle, whether the handles fold or not.

It may be recognized by the user that the attachment mechanism between the first and second pliers units is similar to the technology known as "channel locks." In general, channel locks will comprise an arcuate extension, which is roughly positioned behind the location indicated at 250, and this arcuate extension is configured to engage one of a plurality of arcuate slots 252. In general, the arcuate extension pivots substantially around a pivot (but does not necessarily need to pivot concentrically therearound) which is roughly defined by the center point of the attachment pin 254. The attachment pin is configured to extend through the surface defining a slot 256 so as to hold the first and second plier units 53*j* and 55*j* together. It of course can be appreciated by individuals familiar with channel locks that the plier units can rotate in a manner so the first and second handle portions 44*j* and 36*j* rotate away from one another such that the arcuate extension would disengage from any one of the arcuate slots to allow a transverse repositioning of the respective plier units with respect to one another.

Therefore, it can be generally appreciated that the first and second plier units will rotate with respect to one another, and the user will adjust the plier unit width to approximately engage a size of a material to the interposed between the first and second jaws 28*j* and 30*j*. So referring to FIG. 40, it can be appreciated that a tension member 24*j* can be provided, wherein in one form, either side of the tension member is provided with a plurality of teeth otherwise referred to as longitudinally forward and rearward engagement portions 260 and 262. This plurality of teeth can be configured to engage the first and second engagement members 264 and 266. The first and second engagement members 264 and 266 comprise a tension attachment system 249 to selectively engage and disengage the tension member 24*j*. The engagement members have longitudinally facing and offset engagement regions which in one form comprise a plurality of corresponding teeth 268 and 270 which correspond in approximate depth and frequency with the teeth upon the tension member 24*j*. Therefore, it can be best understood by viewing the FIGS. 40 and 41 that the transverse offset positioning of the first and second engagement members 264 and 266 provide an open interposed channel 270 which is greater than the width of the extended pointed portions of the teeth of the tension member 24*j* to allow the tension attachment system 249 to fully disengage from the tension member.

Therefore, it can be appreciated that the open interposed channel 270 is sufficiently wide in the position as shown in FIG. 40 of the second plier unit 55*j* wherein the second plier unit 55*j* could further open in a counterclockwise direction to ensure the channel-lock slot members are disengaged from one another, and thereafter when the proper arcuate slot 252 is engaged by the arcuate extension of the second plier unit 55*j*, the plier unit 55*j* is rotated to, for example, a position as shown in FIG. 41.

As shown in FIG. 41, it can be appreciated that the plurality of teeth 268 and 270 are in engagement with the corresponding teeth of the tension member 24*j*. These teeth begin to engage prior to rotation past the dead point axis. In this form the dead point axis is approximately extending from the first tension attachment location 70*j* to the pivot point of the locking lever/member 36*j* which in this form of course is comprised of the second plier unit 55*j*. The approximate pivot location of the second plier unit/locking lever is approximately at the second tension attachment location, which present analysis indicates to be approximately at the location interposed between the first and second engagement members 264 and 266 at the location 68*j*. Finally, the center locking point is believed to be approximately at the center of the attachment pin 254 approximately at the location indicated at 38*j*.

Of course, it can be appreciated that various modifications to this embodiment can be employed. For example, the arcuate slots 252 could, for example, be positioned in closer engagement to one another, and there could be a thinner, stronger arcuate extension (not shown) upon the second plier unit 55*j* to provide finer adjustments of the distance between the first and second jaw members 28*j* and 30*j*. Further, the various positions of the first and second engagement members 264 and 266 can be fixedly attached to the second plier unit 55*j* to, for example, allow for greater rotation past the center locking pivot 38*j*. Further, the orientation and length of the plurality of teeth can be adjusted so the lower portion of the teeth on 264 and the upper portion of the teeth of the engagement member 266 would be the first teeth member to engage the corresponding teeth of the tension member 24*j*. These teeth could be reinforced and strengthened by utilizing material science concepts to ensure they do not break under shear stress, and further the pitch of the teeth can be such that there is tension built up between the tension member and the first and second engagement members 264 and 266 as they rotate with respect to one another, so the angled surface of the teeth will build tension and the tension member slides therein as it is locked into place in a matter as shown in FIG. 41. Further, the tension member could, for example, have a secondary pivot point interposed between the first tension attachment location 31 and the second tension attachment location 68*j*, and this second pivot point could for example be in the approximate location indicated at 270 so when the tension member is fully locked it will slightly rotate in a clockwise direction, and the portion of the tension member between the pivot point 71*j* and the approximate point 270 slightly rotates in a clockwise rotation.

Figure 42:
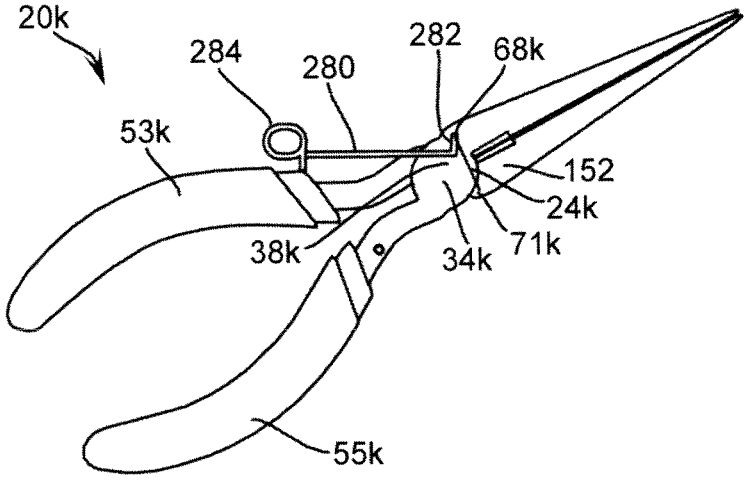
FIG. 42 shows another embodiment of a plier/clamp-like member where the tension member is positioned forward of the pivot attachment between the first and second plier units.
Figure 43:
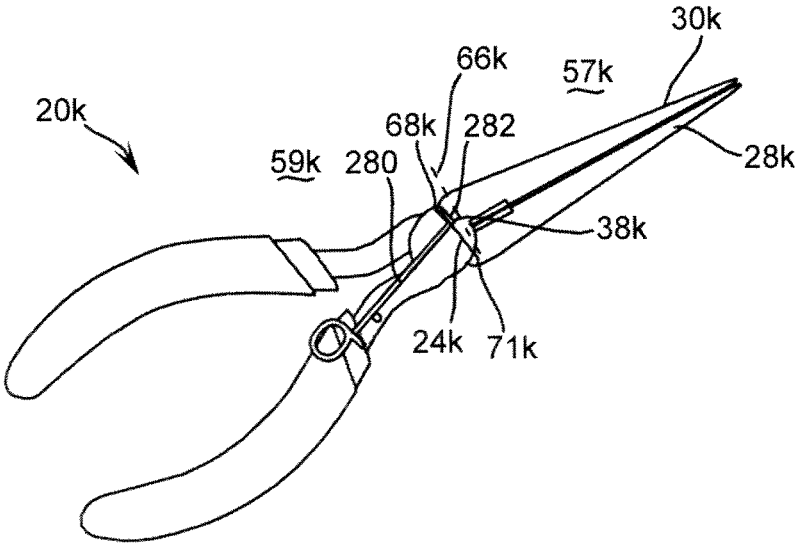
FIG. 43 shows the plier/clamp-like member in a locked orientation.

There will now be a description of yet another embodiment as shown in FIGS. 42 and 43. As shown in FIGS. 42 and 43, there is a needle-nose plier/clamp-like tension locking member 20*k*. This embodiment shows one principle of having the tension member 24K be positioned forward of the pivot attachment locations/the jaw assembly pivot 34*k*. In general, the embodiment 24*k* comprises a first plier unit 53*k* and a second plier unit 55*k*. The tension member 24*k* is attached to the first plier unit at the first tension attachment location 71*k*. The lever member 280 is pivotally attached to the second plier unit 55*k* at the location 38*k*. Finally, the lever extension 282 is provided with the second tension attachment location 68*k*. The lever mechanism 280 has a longitudinally extending portion where, for example, a finger grasp 284 can be provided for manipulation of the lever member 280. As shown in FIG. 43, it can be appreciated that the lever member 280 can be repositioned so the lever extension/locking lever 282 is repositioned to place the second tension attachment location 68*k* to the locked region 59*k* with respect to the dead point axis 66*k*. Of course as shown in FIG. 42, the second tension attachment location 68*k* is positioned in the unlocked region 57*k* with respect to the dead point axis 66 as defined between the points 38*k* and 71.

Therefore, it can be appreciated that FIGS. 42 and 43 in one form show a plier-like member, but in the broader scope could (for example) be a medical surgical clamp wherein the first and second jaw members 28*k* and 30*k* could extend forward in a longitudinal direction and be relatively thin, so the tension member 24*k* is a fixed-length member in this embodiment, and the flex of the jaw members and the tension member can accommodate various widths. For example, if the jaw members are long and relatively thin, than they can operate as a clamp providing a locking force upon the clamp material interposed therebetween. The leverage of the locking can be adjusted by the distance from the pivot attachment location 34*k* of the first and second plier units. Further, the tension member could have a lower modulus of elasticity to accommodate a variety of plier widths but maintain tension therebetween.

Figure 44:
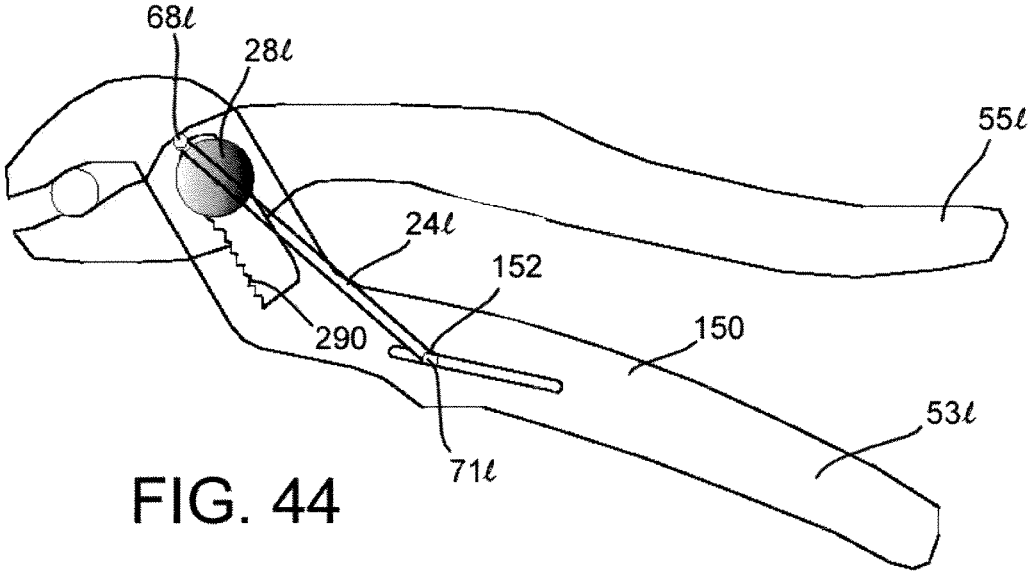
FIG. 44 shows another embodiment of an adjustable plier-like member comprising a locking tension member therein.
Figure 45:
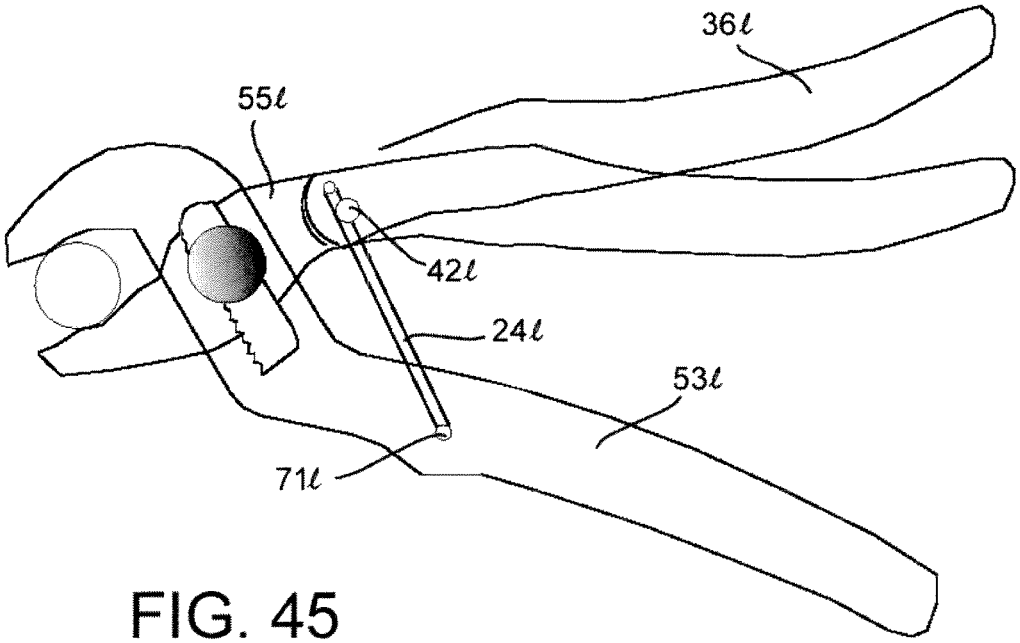
FIG. 45 shows another embodiment of a tension locking member.

FIGS. 44 and 45 show yet another embodiment. This embodiment is similar to a commercial device referred to as the Robogrip™ and further somewhat similar to the embodiments of as shown in U.S. Pat. Nos. 6,212,978 and 6,279,431, which are fully incorporated by reference herein. In this form, the first plier unit 53*l* and the second plier unit 55*l* are connected by an attachment pin 288 which engages a plier width adjustment slot 290. in one form, the tension member 24*l* can be attached in a manner so the second plier unit 55*l* is positioned at a desired tooth extension along the plier width adjustment slot 290 when the second plier unit rotates in a manner so the second tension attachment location 68*l* can rotate past the rotation point to be able to lock the plier units together. Further, the first tension attachment location 71*l* can be adjustable by various systems. FIG. 45 shows a similar concept above, except the locking lever/member 36*l* is pivotally attached about the pin 42*l*, whereas the second plier unit 55*l* is modified from the embodiment in FIG. 44. However, the plier unit 53*l* is similar to that show in FIG. 44. The embodiment in FIG. 45 can have a variety of adjustment mechanisms for the tension member 24*l* as well as the location of the first tension attachment location 71*l* in a manner as described above.

As shown in FIGS. 46-50, there is another embodiment with a fixed length tension member, or at least a substantially fixed length tension member in the broader scope. In general, the tension member 24*m* in one form is attached to the locking lever/member 36*m*, which of course also operates as the second handle in this form. As with previous embodiments in this form with a foldable multi-tool where the handle 36*m* pivots about the pin 42*m*, this tool could of course be a fixed handle member device as well. The first tension attachment location 71*m* is configured to reposition along the tension member adjustment path 81, which can provide adjustment of the first tension attachment location 71*m* by a variety of potential systems. One possible method is to provide an internal adjustment screw which adjusts the location of the first tension connection location 71*m*, or for example pins at 70*m* can be depressed to manually locate the location of the first tension attachment location 71*m*. Alternatively an automatic adjustment system can be employed where the rotation of the jaw assembly 48*m* automatically adjusts the location of the first tension attachment location 71*m*. Because the tension member adjustment path 81 is an arc about the jaw assembly pivot 34*m* and the location of the first tension attachment location 71*m* is directly correlated to the amount of rotation of the second jaw 30*m*, an automatic adjustment system can be employed such as a lever or gear strips and a pinion member so to operate to rotate the first tension attachment location 71*m* with respect to the second jaw 30*m*.

Figure 46:
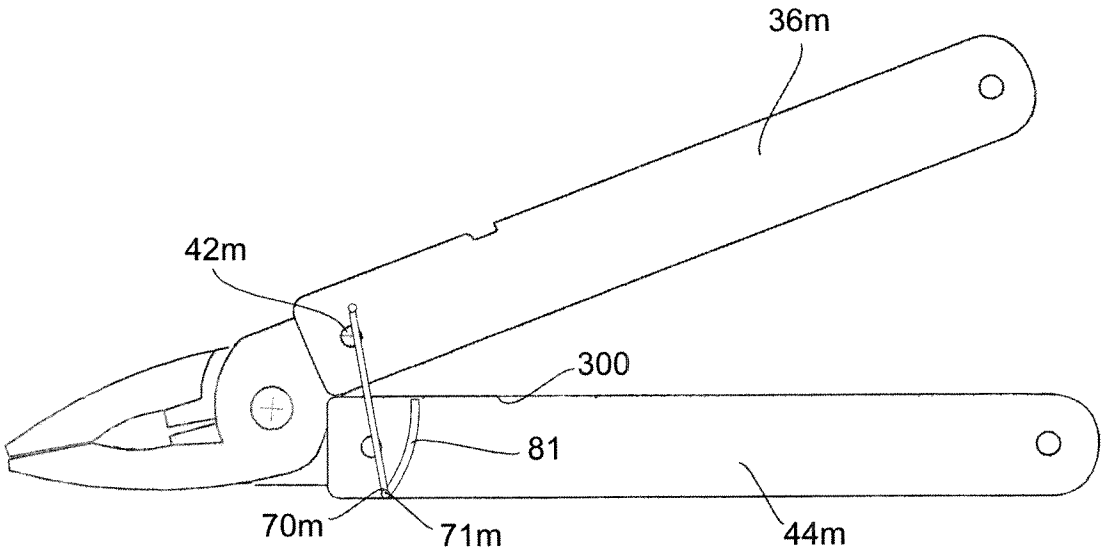
FIG. 46 shows the embodiment where the first connection location of the tension member repositions to provide adjustment of the jaw assembly for clamping differently-sized material.
Figure 47:
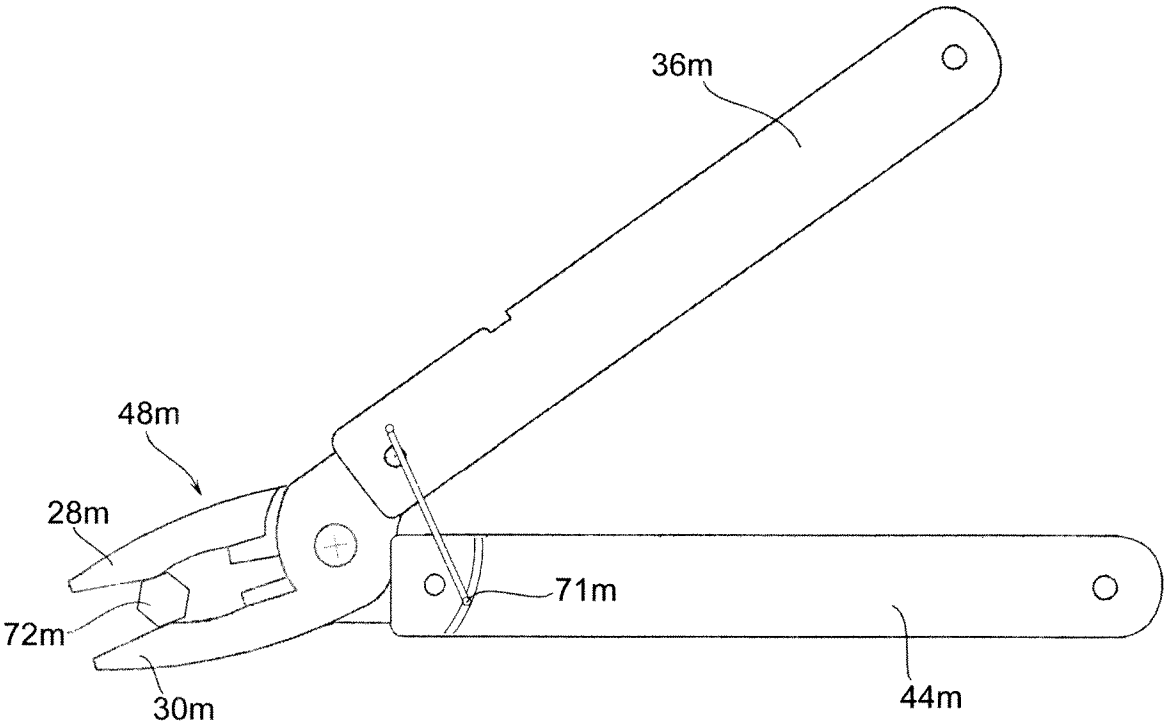
FIG. 47 shows the embodiment of FIG. 46 with a tool piece positioned in between the jaw assembly.
Figure 48:
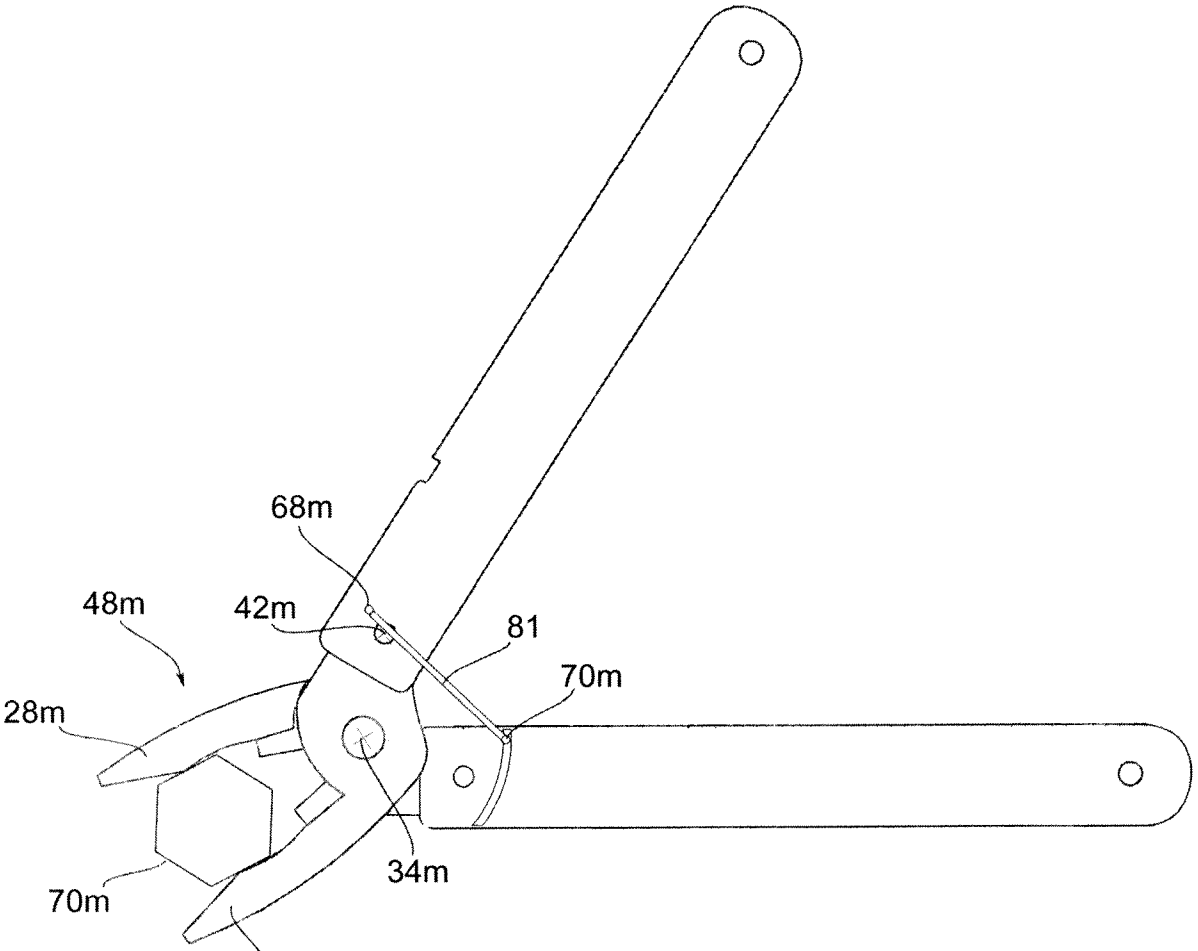
FIG. 48 shows a larger tool piece positioned between the jaw assembly wherein the fixed length of the tension member is maintained and the first attachment location is positioned in a laterally inward portion upon the first handle.

As shown in for example FIG. 47, the jaw assembly 48*m* is in a more open orientation configured to lock a larger material/tool piece 72*m* therebetween. Therefore the first tension member attachment location 71*m* is repositioned further upward along the adjustment path 81. Finally, as shown in FIG. 48, it can be appreciated that the jaw portion 48*m* is in a further widened open position. It can be appreciated that the locking handle 36*m* in FIGS. 46-48 is in a locked orientation with respect to the tension member 24*m*. It should be noted that the arcuate path of the tension member adjustment path 81 is in one form an arc about the jaw assembly pivot 34*m*. By fixing the tension member in the extended length and identifying the first tension attachment location 71*m* and rotating this assembly about the jaws of the pivot 34*m*, a designer can create the desired path 81. Of course, there are a variety of methods of placing the path.

Figure 49:
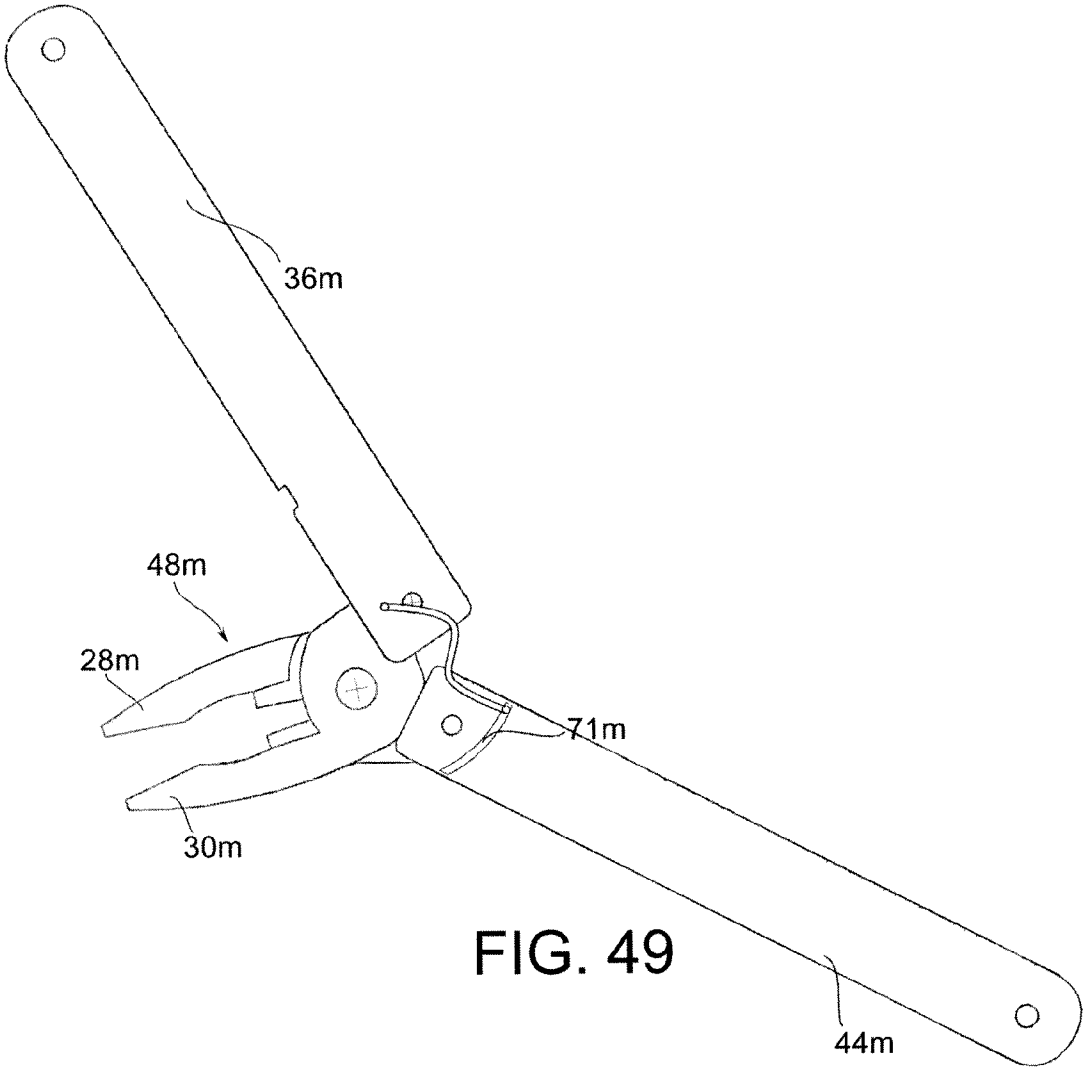
FIG. 49 illustrates how the tool member can fold up as a foldable multitool in one form.

As shown in FIG. 49, it can be appreciated that the first and second handles 44*m* and 36*m* can be folded around the jaw assembly 48*m* and there is sufficient distance of the tension member 24*m* to be positioned therearound to fold the tool. Of course it can be appreciated that the tension member 24*m* can be a flexible piece of material, such as some of the new polymer material such as Kevlar or Spectra, as well as other conventional flexible materials such as steel cable. Of course the attachment system of the pin 70*m* can have an internal threaded member to reposition the location or alternatively the pin 70*m* can be repositioned laterally inwardly to engage and disengage interior gnarled slots or have a similar type of pillow block arrangement as described and shown in FIGS. 28-35.

For example, one type of locking mechanism of pin 71*m* can have a u-shaped channel which folds within the first handle member 44*m*. At the distal portions of the u-shaped handle can be the actual pin member 71, which extends laterally outwardly. The u-shaped interior portion can be fit within the interior channel of the handle member 44*m* and, for example, slide adjacent to the back wall near the reference numeral 300. Therefore, the u-shaped internal member would have an inherent cantilever spring-like quality and near the laterally extending pin portion 71*m* but on the inside portion of the lateral walls of the handle can have the engagement system (such as the plurality of teeth or the like) so when the pen member 71*m* is pinched laterally inwardly on both sides, it is disengaged and can be easily repositioned. Providing a u-shaped interior member allows for the jaw portion to fold inside the handle. Of course, the plurality of types of adjustment mechanisms can be employed, such as having scallops along the slot 81, having an exterior type of block to fix the location of the first tension attachment location 71*m*, and other types of adjustable locking systems.

Figure 50:
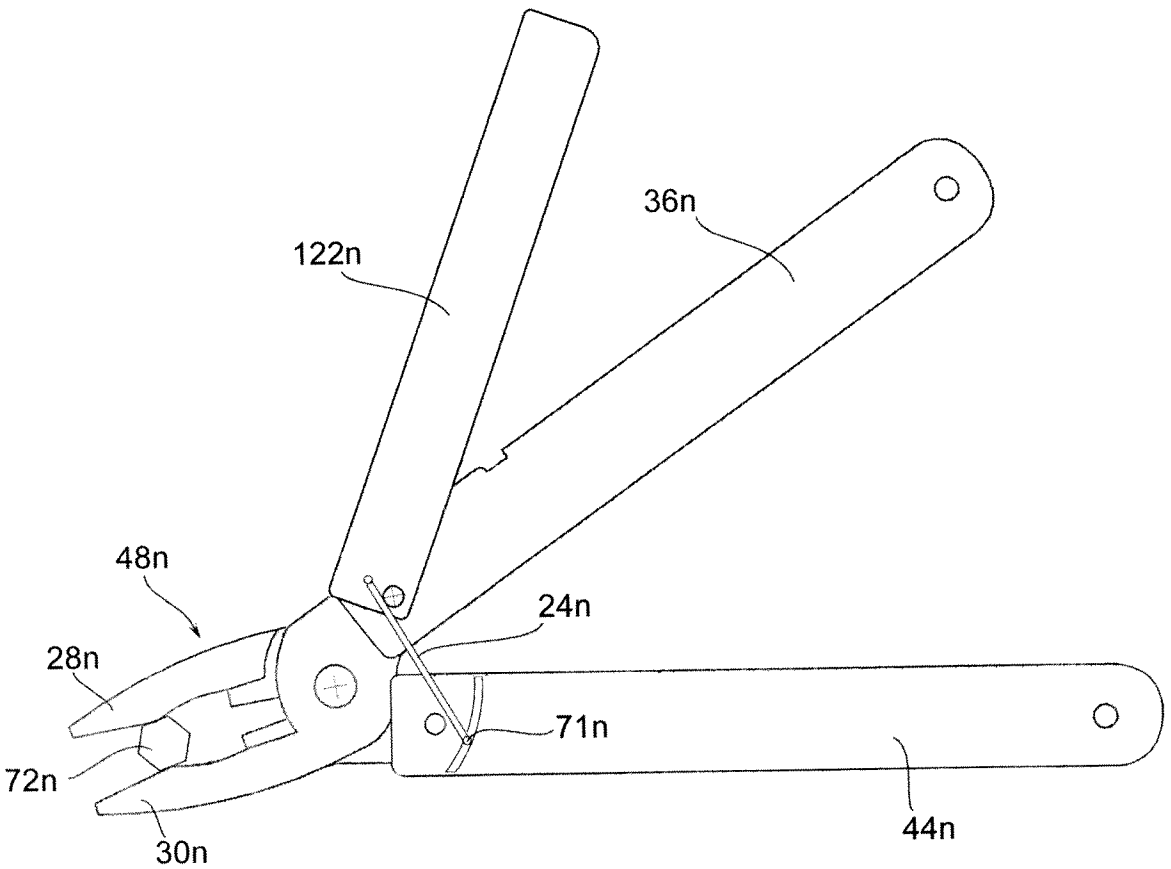
FIG. 50 shows another form of an adjustment system of the first connection location of the tension member.

Further shown in FIG. 50, there is another embodiment similar to that in FIG. 14 providing a secondary outer handle which is operating as the locking handle in conjunction with the second handle 36*n*.

In this form, the locking member/lever is provided as short as 122*n*. Of course, as with all of the embodiments, a plurality of types of locking members can be utilized, such as repositioning the tension member beyond a maximum tension point to reposition it toward a locked position past the dead point center axis. For example, a biasing member can be attached to the tension member so as to pull it past a cam surface to lock the tension member to a locked position. Of course a variety of other types of mechanisms can operate as a lever mechanism for repositioning the tension member from an unlocked position (see FIG. 50) to a locked position.

Figure 51:
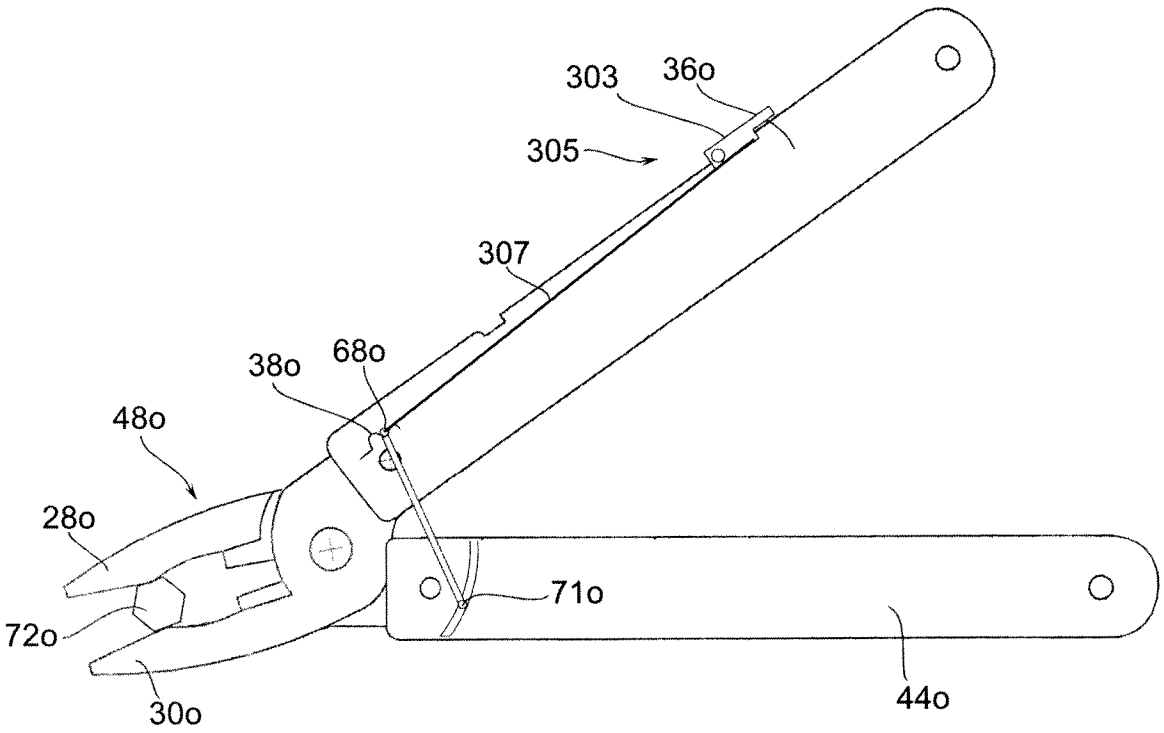
FIG. 51 shows an alternative embodiment showing the locking member as a tension system repositioning the second tension attachment location over a repositioning surface to lock the tool.

As shown in FIG. 51 there is schematically shown another version of a locking member referred to at 305. In this form the lever 305, which is one form of a biasing member, repositions the linkage/cord member 307 to the locked position as shown in FIG. 51. Thereby the second tension attachment location 68*o* is biased over the repositioning surface operating as a center locking pivot 38*o* to lock the jaws laterally inwardly. In other forms the center locking pivot 38*o* itself could reposition by way of an actuator of some sort. Further the member 307 could be sufficiently rigid to bias the second tension attachment location 68*o* to the unlocked position.

Of course the tension upon the tension member can be provided by a plurality of types of locking members such as levers, tensioning members, assemblies and mechanisms, and some examples of such are shown herein above.

It can be appreciated that other embodiments can be employed to adjust the location of the attachment location of the tension member in the various embodiments on the second handle (or on some form of a locking lever in the case where the second handle is not the locking lever itself). In one form a plurality of scallops could be applied to the locking lever where an attachment block is configured to fit into one of the scalloped grooves to adjust the location of the attachment point of the tension member to accommodate a variety of widths of tool pieces grasped between the jaw assembly. In other forms, the first and second attachment locations of the tension member could be fixed, and the center locking pivot of the locking lever will actually reposition to place a second tension attachment location in the locked region with respect to the dead point axis. In other words, the dead point axis would not be static when the locking member clamps down, but will actually reposition to form the extended line of the dead point axis to reposition with respect to the second tension attachment location. The term locking member and locking lever is also defined as a locking system for providing tension upon the tension member.

It should further be noted that the tension member could, for example, be positioned in such an orientation to provide a closing of force upon the first and second handle members when the first and second handle members are in a closed position for a multitool, as shown in FIG. 28.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A compound multitool, comprising:

a first jaw including a first clamping face and a first extension;

a second jaw rotatably coupled to the first jaw by a jaw assembly pivot, the second jaw including a second clamping face and a second extension;

a first handle pivotably coupled to the first extension at a first handle pivot;

a second handle pivotably coupled to the second extension at a second handle pivot;

a second outer handle pivotably coupled to the second handle at an outer handle pivot;

a link member pivotably coupled to the first handle at a first link pivot and coupled to the second handle at a second link pivot, wherein, in an open configuration of the multitool, the first link pivot is located between the jaw assembly pivot and the first handle pivot and the second link pivot is located between the jaw assembly pivot and the second handle pivot; and a tension member attached to the first handle at a first tension attachment location, and attached to the second outer handle at a tension member pivot, a dead point axis being defined along a line extending between the first tension attachment location and the second handle pivot, wherein, in an unlocked position, the second outer handle is in a first position relative to the second handle and the tension member is positioned at a first side of the dead point axis, and, in a locked position, the second outer handle is in a second position relative to the second handle and the tension member is positioned at a second side of the dead point axis, wherein the tension member locks the compound multitool in a clamped configuration as the second outer handle rotates relative to the second handle from the first position to the second position, and the tension member pivot rotates about the outer handle pivot together with the second outer handle and is moved from the first side to the dead point axis to the second side of the dead point axis.

2. The compound multitool of claim 1,. wherein the first handle includes a first plurality of geared fingers and the second handle includes a second plurality of geared fingers operatively configured to interdigitate with the first plurality of geared fingers of the first handle.

3. The compound multitool of claim 1, wherein the first jaw and the first handle are formed as a unitary structure.

4. The compound multitool of claim 1, wherein, in the first position of the second outer handle, the second outer handle is rotated away from the second handle such that the tension member pivot is positioned at the first side of the dead point axis, and, in the second position of the second outer handle, the second outer handle is positioned adjacent to the second handle such that the tension member pivot is positioned at the second side of the dead point axis.

5. The compound multitool of claim 1, wherein the tension member includes a clip that attaches a first end of the tension member to the tension member pivot, the clip including a first extension received in a first opening at a first side of the second outer handle, and a second extension received in a second opening at a second side of the second outer handle.

6. The compound multitool of claim 5, wherein the tension member is rotatably coupled to the second outer handle by the first and second clip extensions received in the first and second holes, respectively, such that tension of the tension member is increased in response to a rotation of the second outer handle toward the second handle.

7. The compound multitool of claim 6, wherein the tension member is coupled to the second outer handle by the clip and the second outer handle is coupled to the second handle such that rotation of the second outer handle towards the first handle moves the tension member from the first side of the dead point axis to the second side of the dead point axis.

8. The compound multitool of claim 1, further comprising an adjustment mechanism in the first handle, operably coupled to the tension member, and configured to adjust a position of the tension member in the first handle based on a selected clamping position of the multitool.

9. A compound multitool, comprising:

a jaw assembly including a first jaw rotatably coupled to a second jaw by a jaw assembly pivot;

a handle assembly, including:

a first handle rotatably coupled to the first jaw by a first handle pivot;

a second handle rotatably coupled to the second jaw by a second handle pivot;

a link linking the first handle and the second handle, the link member being coupled to the first handle at a first link pivot and coupled to the second handle at a second link pivot; and an outer handle rotatably coupled to the second handle by an outer handle pivot, wherein the first link pivot is positioned between the jaw assembly pivot and the first handle pivot, and the second link pivot is positioned between the jaw assembly pivot and the second handle pivot; and a tension member having a first end thereof attached to the first handle at a first tension attachment location and a second end thereof attached to the second outer handle at a tension member pivot, a dead point axis being defined between the first tension attachment location and the second handle pivot, wherein, as the outer handle rotates about the outer handle pivot, from a first position separated from the second handle to a second position adjacent to the second handle, the tension member pivot rotates about the outer handle pivot together with the outer handle to move the tension member from a first side of the dead point axis to a second side of the dead point axis and lock the multitool in a clamped configuration.

10. The compound multitool of claim 9, wherein the first handle includes a first plurality of gear teeth at least partially surrounding the first link pivot, and the second handle includes a second plurality of gear teeth surrounding the second link pivot and configured to inter-engage the first plurality of gear teeth as the first handle and the second handle rotate relative to each other.

11. The compound multitool of claim 9, further comprising an adjustment mechanism in the first handle, operably coupled to the tension member, and configured to adjust a position of the first end of the tension member in the first handle based on a selected clamping position of the multitool.

12. The compound multitool of claim 9, wherein, in the first position of the outer handle, the tension member pivot is positioned at a forward side of the dead point axis, and, in the second position of the outer handle, the tension member pivot is positioned at an aft side of the dead point axis.

13. The compound multitool of claim 9, wherein the tension member includes a clip that attaches a first end of the tension member to the tension member pivot, the clip including a first extension received in a first opening at a first side of the outer handle, and a second extension received in a opening at a second side of the outer handle.

14. The compound multitool of claim 13, wherein the tension member is rotatably coupled to the outer handle by the first and second clip extensions received in the first and second holes, respectively, such that a tension level of the tension member is increased in response to rotation of the outer handle toward the second handle.

15. The compound multitool of claim 13, wherein the tension member is coupled to the second outer handle by the clip and the outer handle is coupled to the second handle such that rotation of the outer handle towards the first handle moves the tension member from the first side of the dead point axis to the second side of the dead point axis.

* * * * *

UNITED STATES PATENT AND TRADEMARK OFFICE

CERTIFICATE OF CORRECTION

PATENT NO. : 9,085,066 B2
APPLICATION NO. : 12/881030
DATED : July 21, 2015
INVENTOR(S) : Christopher Andrew Mattson et al.

It is certified that error appears in the above-identified patent and that said Letters Patent is hereby corrected as shown below:

In the claims,

In column 26, line 24, in claim 2, delete "1,." and insert -- 1, --, therefor.

Signed and Sealed this
Twelfth Day of January, 2016

Michelle K. Lee

Michelle K. Lee
*Director of the United States Patent and Trademark Office*